US008346135B2

(12) United States Patent
Kikuchi et al.

(10) Patent No.: US 8,346,135 B2
(45) Date of Patent: Jan. 1, 2013

(54) POWDER CONVEYANCE DEVICE HAVING A POWDER CONVEYANCE PIPE WITH FIRST, SECOND, AND THIRD CONVEYANCE SECTIONS

(75) Inventors: Kenji Kikuchi, Zama (JP); Eisuke Hori, Tokyo (JP); Hideki Kimura, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 721 days.

(21) Appl. No.: 12/494,939

(22) Filed: Jun. 30, 2009

(65) Prior Publication Data

US 2010/0003055 A1 Jan. 7, 2010

(30) Foreign Application Priority Data

Jul. 1, 2008 (JP) ..... 2008-172741
Nov. 26, 2008 (JP) ..... 2008-300660

(51) Int. Cl.
*G03G 15/08* (2006.01)

(52) U.S. Cl. ..... 399/260; 399/258

(58) Field of Classification Search ..... 399/258, 399/259, 260
See application file for complete search history.

(56) References Cited

U.S. PATENT DOCUMENTS 5,729,804 A 3/1998 Aruga et al.
6,505,026 B2 1/2003 Hayakawa et al.
6,826,381 B2 11/2004 Muramatsu et al.
7,043,182 B2 5/2006 Sakai et al.
7,050,744 B2 * 5/2006 Tamura et al. ..... 399/258
7,062,207 B2 * 6/2006 Tsuda et al. ..... 399/260
7,076,192 B2 * 7/2006 Tsuda et al. ..... 399/258
7,212,773 B2 5/2007 Sudo et al.
7,228,093 B2 6/2007 Sakai et al.
7,272,342 B2 9/2007 Nagashima et al.
7,325,908 B2 2/2008 Katoh et al.
7,457,570 B2 11/2008 Kasai et al.
7,512,373 B2 * 3/2009 Shimizu ..... 399/358
7,540,598 B2 6/2009 Hori et al.

(Continued)

FOREIGN PATENT DOCUMENTS

EP 0 652 493 A2 5/1995

(Continued)

*Primary Examiner* — David Gray
*Assistant Examiner* — Laura Roth
(74) *Attorney, Agent, or Firm* — Oblon, Spivak, McClelland, Maier & Neustadt, L.L.P.

(57) ABSTRACT

A powder conveyance device includes a powder conveyance pipe having a first conveyance section communicating with the powder container section and having a supply inlet to receive powder from a powder container. A second conveyance section is provided in the powder conveyance pipe to communicate downstream with the first conveyance section via a first bending section. The second conveyance section downwardly extends to the conveyance destination being inclined from a horizontal at a larger angle than the first conveyance section. A third conveyance section is also provided in the powder conveyance pipe to communicate downstream with the second conveyance section via a second bending section. The third conveyance section extends toward the conveyance destination being inclined from the horizontal at a smaller angle than the second conveyance section. The third conveyance section has a replenishment outlet for replenishing the powder from the powder conveyance pipe to the powder conveyance destination.

18 Claims, 16 Drawing Sheets

U.S. PATENT DOCUMENTS

| | | | | |
|---|---|---|---|---|
| 7,787,784 | B2 * | 8/2010 | Hori | 399/27 |
| 2005/0031374 | A1 | 2/2005 | Nagashima et al. | |
| 2007/0053723 | A1 | 3/2007 | Iwata et al. | |
| 2007/0104516 | A1 | 5/2007 | Katoh et al. | |
| 2008/0013982 | A1 | 1/2008 | Kimura | |
| 2008/0025743 | A1 | 1/2008 | Hori | |
| 2008/0094458 | A1 | 4/2008 | Bannai et al. | |
| 2008/0205937 | A1 | 8/2008 | Hori et al. | |
| 2009/0022504 | A1 | 1/2009 | Kuwabara et al. | |
| 2009/0047036 | A1 | 2/2009 | Hori et al. | |

FOREIGN PATENT DOCUMENTS

| | | | | |
|---|---|---|---|---|
| EP | 0 652 493 | A3 | | 5/1995 |
| JP | 2001222196 | A | * | 8/2001 |
| JP | 2003345201 | A | * | 12/2003 |
| JP | 2005-24665 | | | 1/2005 |
| JP | 2007010921 | A | * | 1/2007 |
| JP | 2007-121828 | | | 5/2007 |
| JP | 2007286322 | A | * | 11/2007 |

* cited by examiner

Related Art

FIG. 20

TABLE 1

| SECTIONS WHERE SPACE RESTRICTING MEMBER ARRANGED ON SLOPE IN TONER CONVEYANCE PIPE HAS DIAMETER OF 4.2 | TONER AGGREGATION RANK |
|---|---|
| ALL | 1 |
| FROM TIP TO SECTION DISTANCED THEREFROM IN AXIAL DIRECTION BY 20mm | 3 |
| FROM TIP TO SECTION DISTANCED THEREFROM IN AXIAL DIRECTION BY 16mm | 5 |
| FROM TIP TO SECTION DISTANCED THEREFROM IN AXIAL DIRECTION BY 10mm | 5 |

POWDER CONVEYANCE DEVICE HAVING A POWDER CONVEYANCE PIPE WITH FIRST, SECOND, AND THIRD CONVEYANCE SECTIONS

CROSS REFERENCE TO RELATED APPLICATION

This application claims priority under 35 USC §119 to Japanese Patent Application Nos. 2008-172741, filed on Jul. 1, 2008, and 2008-300660, filed on Nov. 26, 2008, the entire contents of which are herein incorporated by reference.

BACKGROUND OF THE INVENTION

1. Field of the Invention

The present invention relates to a powder conveyance device capable of conveying powder, such as toner, etc., from a powder container section to a conveyance destination located downstream of the powder container section via a powder conveyance pipe, an image forming apparatus including the powder conveyance device, and a process cartridge.

2. Discussion of the Background Art

Conventionally, an image forming apparatus, such as a copier, a facsimile, a printer, etc., equipped with a toner conveyance device has been known.

As shown in FIG. 19, the Japanese Patent Application Laid Open No. 2005-024665 describes a toner conveyance device that employs a toner conveyance pipe for guiding toner from a toner container section that stores the toner to a developing device provided below the toner container section. The toner conveyance pipe 143 includes a upstream side horizontal section 143*a* communicating with the toner container section 147 while substantially extending horizontally, a slant section 143*c* largely inclining downward a developing device 155 on the downstream side of the upstream side horizontal section 143*a*, and a downstream side horizontal section 143*e* substantially extending horizontally while communicating with a developing device 155 at the downstream side of the slant section 143*c*. A conveyance coil 170 is provided in the toner conveyance pipe 143 to stir and convey the toner.

The toner installed in the toner container section 147 is conveyed to the upstream side horizontal section 143*a* by the conveyance coil 170. When the toner conveyed to the upstream side horizontal section 143*a* is further conveyed to the slant section 143*c* by the conveyance coil 170, the toner drops down to the downstream side horizontal section 143*e* at once from the slant section 143*c* by its own weight in addition to a conveyance force provided by the conveyance coil 170. In this way, the toner conveyed to the downstream side horizontal section 143*e* is further conveyed by the conveyance coil 170 to a replenishment inlet 145 communicating with the developing device 155, whereby the toner is ejected to the developing device 155.

Since the toner drops down at the slant section 143*c* to the downstream side horizontal section 143*e* at once by its own weight in addition to the conveyance force from the conveyance coil 170, the toner scarcely accumulate thereon and most part of the space in the pipe of the slant section 143*c* is occupied by air. The toner is blended with air by the conveyance coil 170 or the like in the toner conveyance pipe 143. Especially, at the slant section 143*c* where the inside of the pipe space is almost occupied by the air, the toner tends to be blended with the air more than the other section. As a matter of fact, the higher the rate at which the toner is blended with air, the higher the toner fluidity is.

Thus, at the slant section 143*c* where the toner is readily blended with air, the toner is excessively blended therewith, whereby the fluidity of the toner excessively increases. When the fluidity of the toner excessively increases, the toner behaves like liquid, and ends up flowing from the slant section 143*c* to the developing device 155 at once via the replenishment inlet 145 without conveyance of the conveyance coil 170 due to a dropping force caused when dropping down the slant section 143*c*.

In this way, when the toner flows at once from the replenishment inlet 145 into the developing device 155 regardless of the conveyance of the conveyance coil 170, toner replenishment to the developing device 155 results in unstable.

SUMMARY OF THE INVENTION

The present invention has been made in view of the above noted and another problems and one object of the present invention is to provide a new and noble powder conveyance device. Such a new and noble powder conveyance device includes a powder container section that contains powder, a powder conveyance pipe that guides downstream the powder mixed with air from the powder container section, and a powder conveyance member that conveys the powder installed in the powder conveyance pipe toward a conveyance destination. The powder conveyance pipe includes a first conveyance section having a supply inlet and communicating with the powder container section. The first conveyance section receives the powder from the powder container through the supply inlet. A second conveyance section is provided in the powder conveyance pipe to communicate downstream with the first conveyance section via a first bending section. The second conveyance section downwardly extends to the conveyance destination being inclined from a horizontal at a larger angle than the first conveyance section. A third conveyance section is also provided in the powder conveyance pipe to communicate downstream with the second conveyance section via a second bending section. The third conveyance section extends toward the conveyance destination being inclined from the horizontal at a smaller angle than the second conveyance section. The third conveyance section has a replenishment outlet for replenishing the powder from the powder conveyance pipe to the powder conveyance destination. A space restriction member is provided in the powder conveyance pipe and is at least arranged in the second conveyance section to partially close an inner space of the second conveyance section.

In another embodiment, a powder passage restriction section is arranged in the first conveyance section to restrict passage of the powder.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 20 illustrates an exemplary result of experiencing of toner aggregation.

DESCRIPTION OF PREFERRED EMBODIMENTS

Figure 1:
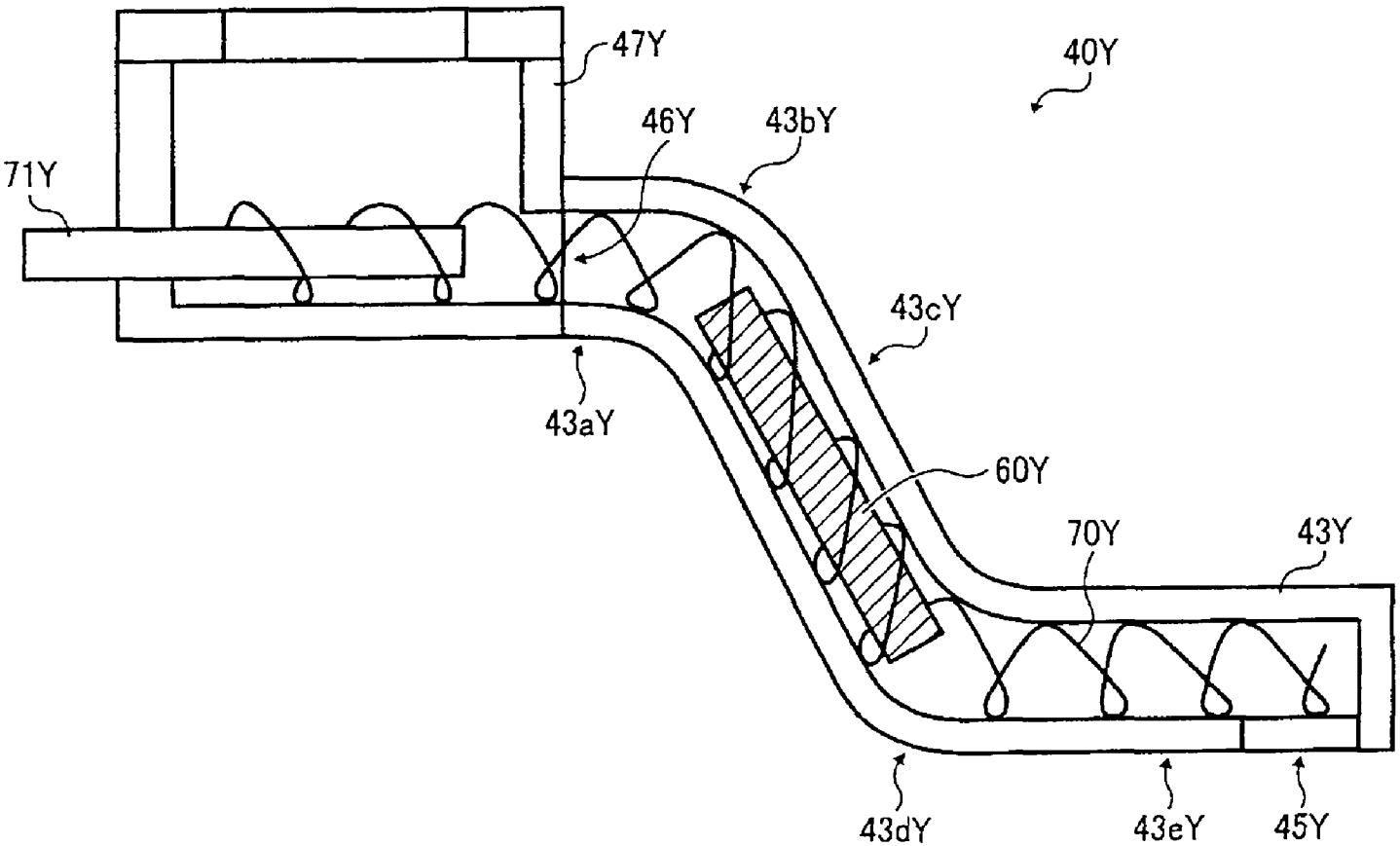
FIG. 1 schematically illustrates an exemplary toner conveyance device having a first configuration according to one embodiment of the present invention.

Referring now to the drawings, wherein like reference numerals and marks designate identical or corresponding parts throughout several figures, in particular in FIG. 1, a first embodiment including a printer that employs an electrophotographic system is described. Initially, a fundamental configuration of the printer is described with reference to FIG. 2. As shown, the printer 100 includes four process cartridges, which create toner images of yellow, magenta, cyan, and black (hereinafter referred to as Y, M, C, and K), respectively. Although these use Y to K different toner as image formation substance from each other, they have the same configuration and are replaced with new ones when arriving at their lives.

Figure 3:
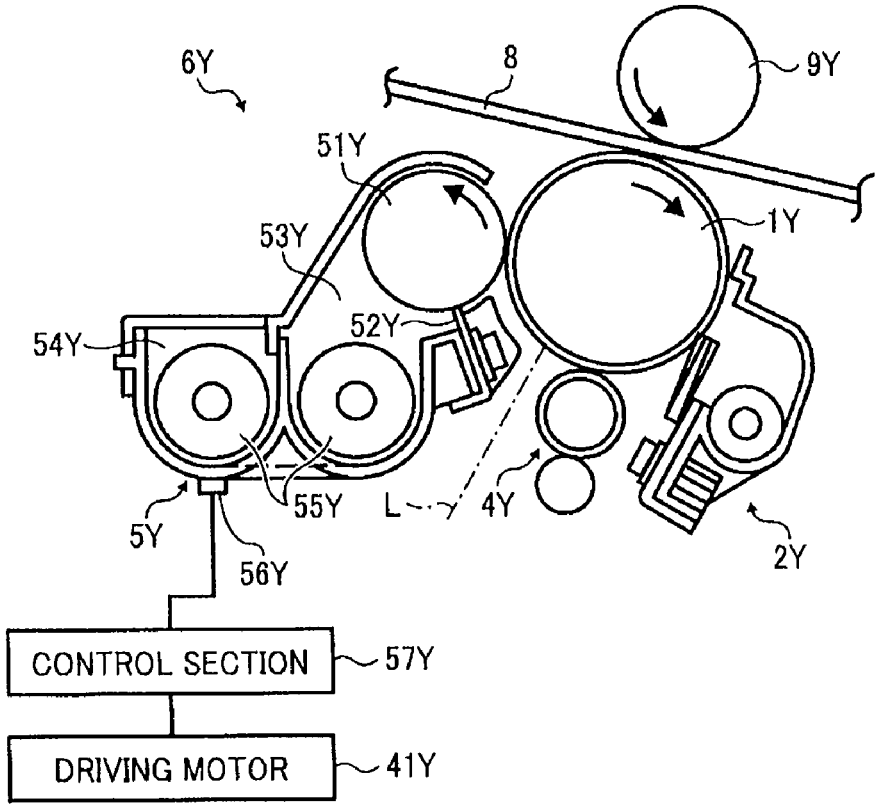
FIG. 3 illustrates an exemplary process cartridge for Y use and surroundings thereof according to one embodiment of the present invention.

To typically explain details with reference to a process cartridge 6Y that creates a Y toner image, as shown in FIG. 3, the process cartridge 6Y includes a drum shaped photoconductive member 1Y, a drum cleaning device 2Y, a charge removing device (not shown), a charging device 4Y, and a developing device 5Y, and the like. The process cartridge 6Y is detachable to a printer body 100, whereby consumption parts can be replaced at once.

Thus, each of the four process cartridges 6Y to 6K includes the photoconductive member 1, the drum-cleaning device 2, the discharge device (not shown), the charge device, and the developing device 5. The photoconductive member 1, the drum cleaning device 2, the discharge device (not shown), the charge device, and the developing device 5 are integrated and detached to the printer body. Conventionally, each of these, such as the photoconductive member 1, etc., is separately detached as consumption parts and is replaced upon need. However, since it was difficult for an operator to recognize a detachment manner, usability of each is inferior.

Then, a process cartridge system comes up to improve the usability by integrally replacing these and recognizing the end of the life when toner disappears from the developing device. However, with such a configuration, parts yet having their lives are forcibly replaced when the toner disappears from the developing device, waist of parts increases.

It is also known that an image forming apparatus includes a process cartridge, to which a toner container storing toner to be supplied to a developing device included in a process cartridge is detached. However, in such an image forming apparatus, even though only the toner container is replaced, the process cartridge need be detached from the image forming apparatus body. Thus, usability of a toner container is defective.

Then, in this printer 100, the process cartridges 6Y to 6K and the toner bottle 32Y to 32K are separately detached to the printer body so as to resolve such a problem.

The charge device 4Y is rotated by a driving device, not shown, clockwise in the drawing and uniformly charge the surface of the photoconductive member 1Y. The surface of the photoconductive member 1Y with the uniform charge is subjected to exposure scanning of a laser light L, whereby carrying a latent image for Y use. The latent image of Y use is developed to a Y toner image by the developing device 5Y using T toner. Then, the Y toner image is transferred onto an intermediate transfer belt 8. A drum cleaning device 2Y removes toner remaining on the surface of the photoconductive member 1Y after the intermediate transfer process. The charge-removing device removes electrode remaining on the photoconductive member 1Y after the cleaning. Due to the charge removal, the surface of the photoconductive member 1Y is initialized and becomes ready for the next image formation.

M to K toner images are similarly formed on the photoconductive members 1M to 1K in the other process cartridges 6M to 6K, and are subjected to intermediate transfer onto the intermediate transfer belt 8.

Figure 2:
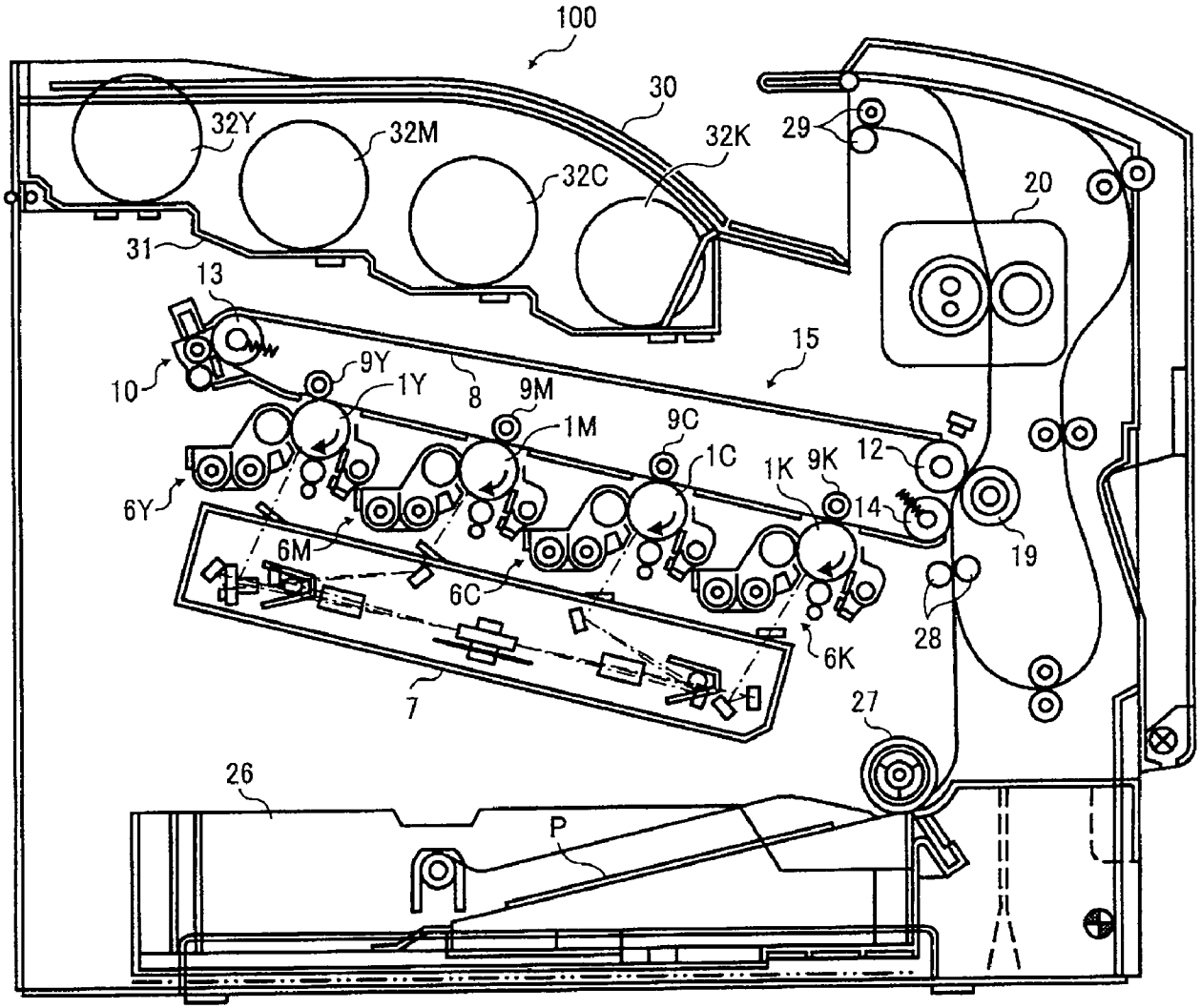
FIG. 2 schematically illustrates an exemplary printer according to one embodiment of the present invention.

As shown in FIG. 2, an exposure device 7 is arranged below the process cartridges 6Y to 6K as a latent image formation device. The exposure device 7 executes exposure by emitting a laser light L in accordance with image information to photoconductive members 1 included in the process cartridges 6Y to 6K, respectively. By this exposure, latent images are formed on the photoconductive members 1Y to 1K, respectively. The above-mentioned exposure device 7 defuses and emits the laser light L created by a light source with a polygon mirror driven by a motor onto the photoconductive members 1 via plural optical lenses and mirrors.

Below the exposure device 7, a sheet-feeding device including a sheet container cassette 26, a sheet-feeding roller 27, and a pair of rollers 28 installed in the sheet container cassette 26 are arranged. The sheet container cassette 26 includes plural transfer sheets P being piled as a printing member. The sheet-feeding roller 27 contacts the topmost transfer sheet P. When the sheet-feeding roller 27 is rotated counter clockwise by a driving device, not shown, the topmost sheet P is fed toward the pair of rollers 28. The pair of registration roller 28 rotates and immediately stops rotating while sandwiching the transfer sheet P therebetween. Then, the pair of registration rollers launches the transfer sheet P toward a later mentioned secondary transfer nip at an appropriate time. Thus configured sheet feeding device serves as a conveyance device by combining the sheet feeding roller 27, and the pair of registration rollers 28 serving as a pair of timing rollers. The conveyance device conveys the transfer sheet P from the sheet container cassette 26 to the secondary transfer nip.

Above the process cartridges 6Y to 6K, an intermediate transfer unit 15 including an intermediate transfer belt 8 suspended and endlessly driven is arranged. The intermediate transfer unit 15 also includes four primary transfer bias rollers 9Y to 9K, a cleaning device 10, a secondary transfer backup roller 12, a cleaning backup roller 13, a tension roller 14 and the like. The intermediate transfer belt 8 is suspended by these three rollers and is endlessly driven counter clockwise by one of them.

These primary transfer bias rollers 9Y to 9K sandwiches the intermediate transfer belt 8 with the photoconductive members 1Y to 1K and form primary transfer nips there between, respectively. These primary transfer bias rollers 9Y to 9K apply a transfer bias having an opposite polarity (e.g. positive) to that of toner to the rear side surface of the intermediate transfer belt 8. All of rollers other than the primary transfer bias rollers 9Y to 9K are grounded. The intermediate transfer belt 8 receives primary transfer in which Y to K toner images formed on the photoconductive members 1Y to 1K are superimposed in turn when passing through the primary transfer nips for Y to K uses as endlessly travels. Thus, four-color superimposing toner images are formed on the intermediate transfer belt 8 as a four-color toner image.

The secondary backup roller 12 sandwiches the intermediate transfer belt 8 with the secondary transfer roller 19 and create a secondary transfer nip. The four-color toner image on the intermediate transfer belt 8 is transferred onto a transfer sheet P at the secondary transfer nip. Some toner not transferred onto the transfer sheet P remains on the intermediate transfer belt 8 after passing through the secondary transfer nip, and is removed by a clean device 10.

In the above-mentioned secondary transfer nip, the transfer sheet P is sandwiched by the intermediate transfer belt 8 and secondary transfer roller 19, surfaces of which are moving in the same direction, and is conveyed in the direction opposite to the side of the pair of registration rollers 28. The four color toner image transferred onto transfer sheet P launched from the secondary transfer nip is fixed onto the surface thereof by heat and pressure when passing through the rollers of the fixing device 20. After that, the transfer sheet P is ejected outside via a pair of sheet ejection rollers 29. A stack section 30 is arranged on the upper surface of the printer body. The transfer sheet P ejected outside by the pair of sheet ejection rollers 29 are stacked one by one on the stack section 30.

Now, an exemplary configuration of the developing device 5Y included in the process cartridge 6Y is described with reference to FIG. 3. The developing device 5Y includes a magnetic field generating device. Specifically, as shown, the developing device 5Y includes a developing sleeve 51Y carrying and conveying two-component developer having magnetic particle and toner on its surface as a developer carrier member. Also included is a doctor 52Y to smooth the developer carrier on the developing sleeve 51Y in a prescribed thickness as a developer restriction member. On the upstream side of the developer conveyance direction of the doctor 52Y, a developer container section 53Y is arranged to contain the developer not conveyed to a developing region opposing the photoconductive member 1Y and having been smoothed. Further, neighboring to the developer container section 53Y, a developer container section 54Y containing developer and two developer conveyance screws 55Y for stirring and conveying the developer are provided.

Now, an exemplary operation of the developing device is described with reference to FIG. 2. As shown, a development layer is formed on the developing sleeve 51Y in the developing device 5Y. Toner is taken in to developer from the developer container 53Y due to movement of the development layer conveyed by rotation of the developing sleeve 51Y. Such taking in of the toner is executed to control toner density to fall within a prescribed range. The toner taken in the developer is charged by friction with carrier. The developer with the charged toner is supplied and carried on the surface of the developing sleeve 51Y installing a magnetic pole by magnetic force. The developer layer carried on the developing sleeve 51Y is conveyed in a direction shown by an arrow as the developing sleeve 51Y rotates. After the doctor 52Y smooths the development layer in a prescribed thickness, the developer is carried to the developing region opposing the photoconductive member 1Y. In the developing region, the latent image on the photoconductive member 1Y is developed. The developer layer remaining on the developing sleeve 51Y is conveyed toward the upstream section in the developer conveyance direction of the developer container section 53Y as the developing sleeve 51Y rotates.

Back to FIG. 2, a bottle container 31 is arranged between the intermediate transfer unit 15 and the stack section 30 arranged above the intermediate transfer unit 15. The bottle container 31 includes toner bottles 32Y to 32K storing Y to K toner, respectively. The toner bottles 32Y to 32K are arranged on the bottle containers 31 of respective toner colors from above. The Y to K toner in the toner bottles 32Y to 32K are replenished appropriately to the developing devices in the process cartridges 6Y to 6K, respectively, by a toner conveyance device as mentioned later in detail. These toner bottles 32Y to 32K are detachable to the printer body 100 in dependent from the process cartridges 6Y to 6K, respectively.

Figure 4:
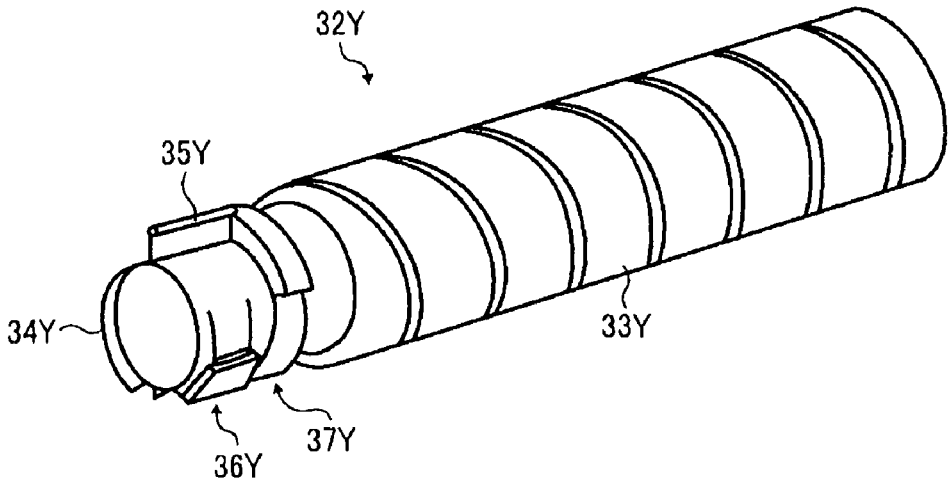
FIG. 4 is a perspective view illustrating an exemplary toner bottle for Y use according to one embodiment of the present invention.
Figure 5:
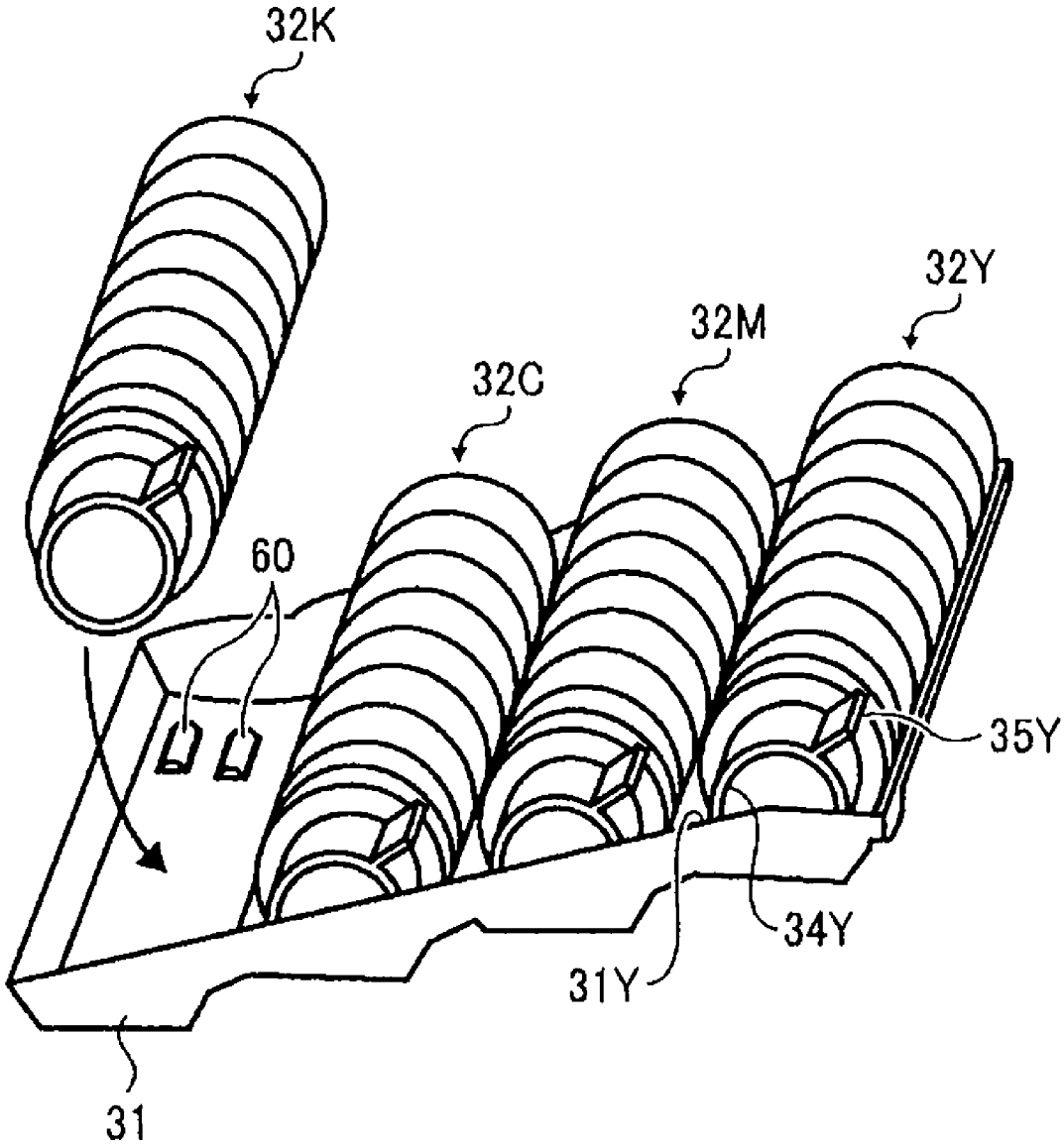
FIG. 5 is a perspective view illustrating an exemplary bottle supporting section and toner bottles of respective colors according to one embodiment of the present invention.

The toner bottle 32Y is described with reference to FIG. 4 more in detail. The toner bottle 32K is mounted on the bottle container 31 as shown in FIG. 5. As shown in FIG. 4, a plastic case 34Y is provided on the leading section of the bottle body 33Y of the toner bottle 32Y. The plastic case 34Y integrally includes a handle 35Y. A gear 37Y is provided on the side of the plastic case 34Y of the bottle body 33Y to integrally rotate with the bottle body 33Y. When the toner bottle 32Y is attached to the body of the printer 100, the stack section 30 is initially open upward to reveal the bottle container 31. Then, as shown in FIG. 5, when the toner bottle 32Y is mounted to the bottle container 31, the handle 35Y is rotated. Then, the plastic case 34Y integral with the handle 35Y is rotated, and the shutter 36Y moves in a circumferential direction of the plastic case 34Y and is open there, whereby a toner ejection outlet, not shown, is open. At same time, the plastic case 34Y is connected and secured to the bottle container 31.

Further, when detaching the toner bottle 32Y from the printer body 100, the handle 35Y is reversely rotated, and the plastic case 34Y is then disengaged with the bottle container 31. Then, a shutter 36Y is closed and the toner ejection outlet is closed. As a result, the toner bottle 32Y can be detached from the body of the printer 100 grasping the handle 35Y.

In this way, since the toner bottle 32Y can be mounted and detached from above the body of the printer 100, the manner of replacement of the toner bottle 32Y can be readily understandable and is simple. Further, since the handle 35Y is formed on the plastic case 34Y, the securing to the bottle container 31 can be easily performed by rotating the plastic case 34Y. When the toner bottle 32Y is detached from the body of the printer 100, the shutter 36Y does not open even when the handle 35Y is rotated. Thus, the shutter 36Y is avoided from being erroneously open during replacement of the toner bottle 32Y suppressing toner leakage.

Figure 6:
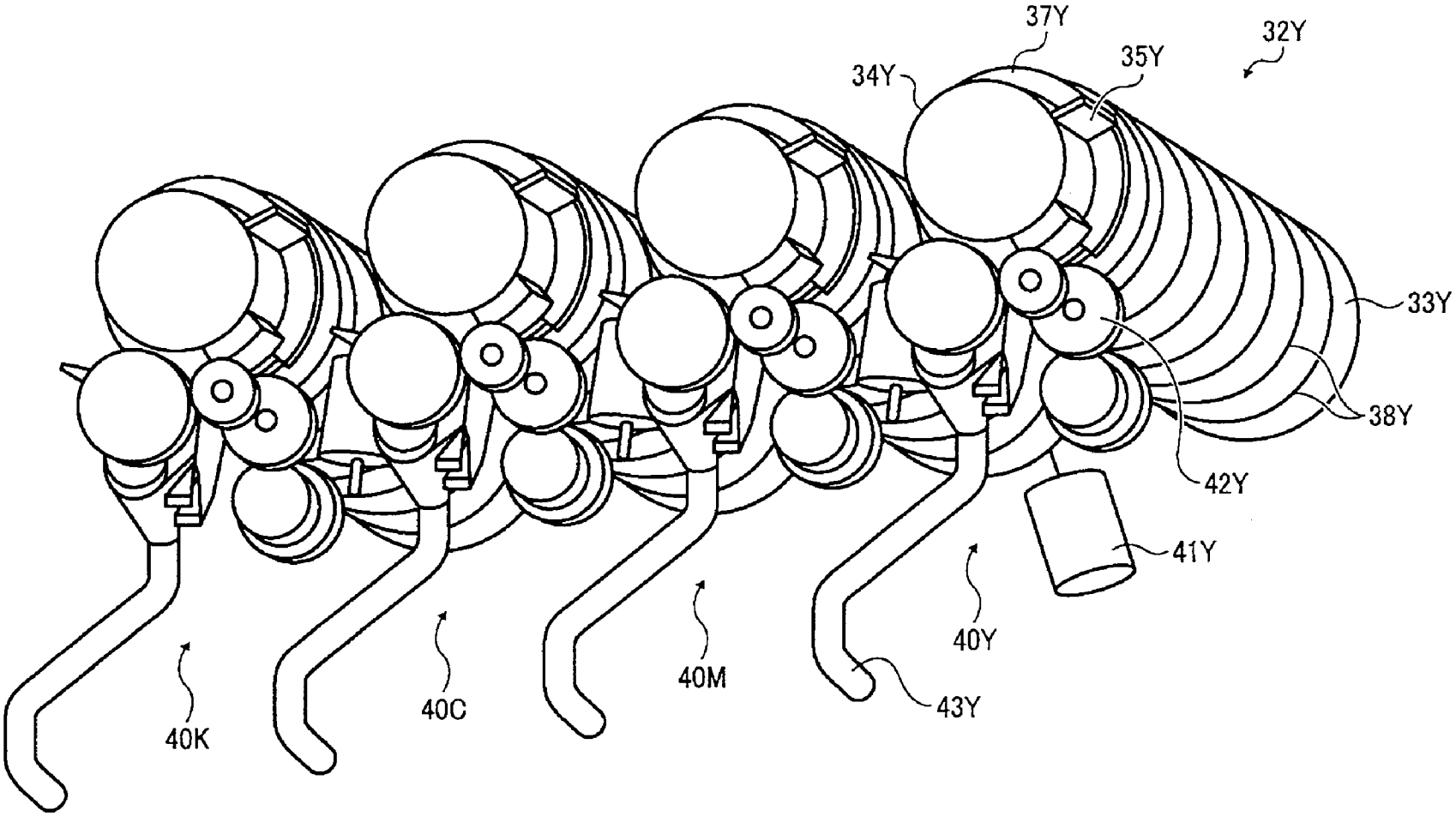
FIG. 6 is a perspective view partially illustrating exemplary toner conveyance devices of respective colors according to one embodiment of the present invention.
Figure 7:
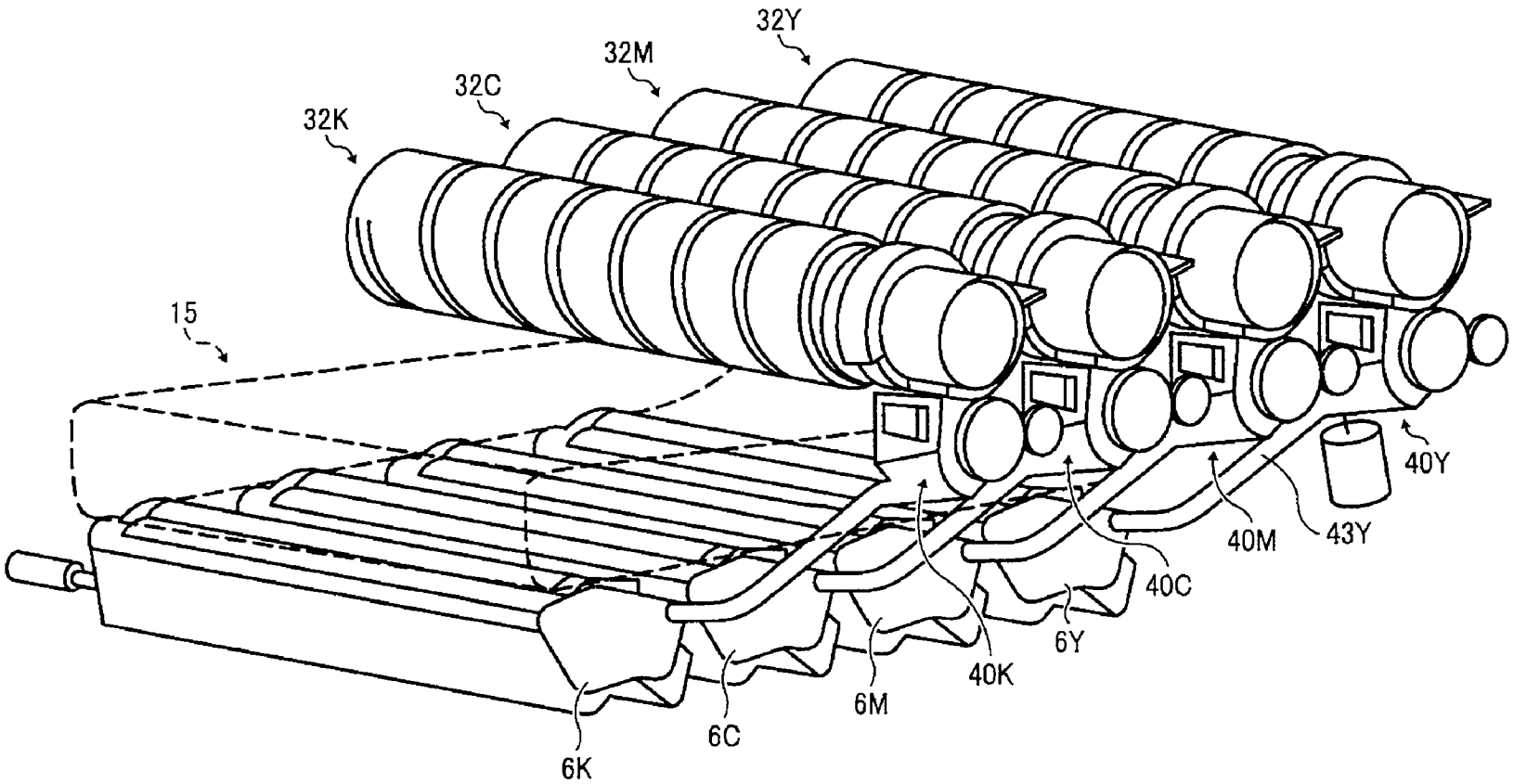
FIG. 7 is a perspective view partially illustrating exemplary toner conveyance devices and process cartridges of respective colors according to one embodiment of the present invention.

Now, the toner conveying device 40 is described with reference to FIGS. 6 and 7, where toner bottles 32Y to 32K and the toner conveying devices 40Y to 40K are illustrated. The toner bottles 32Y to 32K, the intermediate transfer unit 15, and toner conveying devices 40Y to 40K are viewed at a different angle as illustrated in FIG. 7. These toner conveying devices 40Y to 40K are arranged beside the intermediate transfer unit 15 in the body of the printer 100. Thus, since a toner conveying device can be omitted from the process cartridges 6Y to 6K or the toner bottles 32Y to 32K, these devices can be more compact than conventional one. Further, since a conventional process cartridge is arranged adjacent to a toner bottle, there was designing restriction. However, they can separately be arranged according to this embodiment. Thus, a freedom degree of designing can be improved and the printer can be compact.

Ejections outlets of the toner bottles 32Y to 32K, the toner conveying devices 40Y to 40K, and the toner replenishment inlets of the developer container sections 54Y to 54K of the developing devices 5Y to 5K are arranged on one side of the intermediate transfer unit 15. Thus, a toner conveyance path of the toner conveying devices 40Y to 40K can be minimized, and the printer can be compact while suppressing toner clogging during toner conveyance.

Since the configuration of the toner conveying devices 40Y to 40K are substantially the same, the toner conveying device 40Y for Y toner conveyance use is typically described with reference to FIG. 6. As shown, the toner conveying device 40Y mainly includes a driving motor 41Y, a driving gear 42Y, and a toner conveyance pipe 43Y. Inside the toner conveyance pipe 43Y, a plastic coil, not shown, is arranged. The driving gear 42Y meshes with a gear 37Y of the toner bottle 32Y, and is integrally rotated with the gear 37 of the toner bottle 32Y whereby the bottle body 33Y is rotated when the driving motor 41Y is driven. Then, when the density detection sensor 56Y of the developing device 5Y of FIG. 3 detects decreasing of toner density in the developer container section 54Y, a replenishment signal is outputted from the container section 57Y and the driving motor 41Y is rotated. As shown in FIG. 6, since a spiral developer guide groove 38Y is formed on the inner wall surface of the bottle body 33Y, toner stored inside is conveyed from a rear side of the bottle body 33Y to the side of the plastic case 34Y of the leading end by the rotation. Then, the toner in the bottle body 33Y drops through an ejection outlet, not shown, of the plastic case 34Y to a toner reception section, not shown, of the toner conveying device 40Y. The toner reception section communicates with the toner conveyance pipe 43Y, and accordingly, a coil, not shown, installed in the toner conveyance pipe 43Y is simultaneously rotated when the driving motor 41Y is driven and the bottle body 33Y is rotated. Due to the rotation of the coil, the toner dropped on the toner receiving section is conveyed through the toner conveyance pipe 43Y and replenished to a toner replenishment inlet, not shown, of the developer container 54Y. In this way, toner density in the developing device 5Y is adjusted.

Instead of the density detection sensor 56Y, an optical sensor or a CCD camera or the like can be employed to count a number of pixels of a reference image formed on the photoconductive member 1Y, and toner replenishment can be executed based on the calculation.

Figure 8:
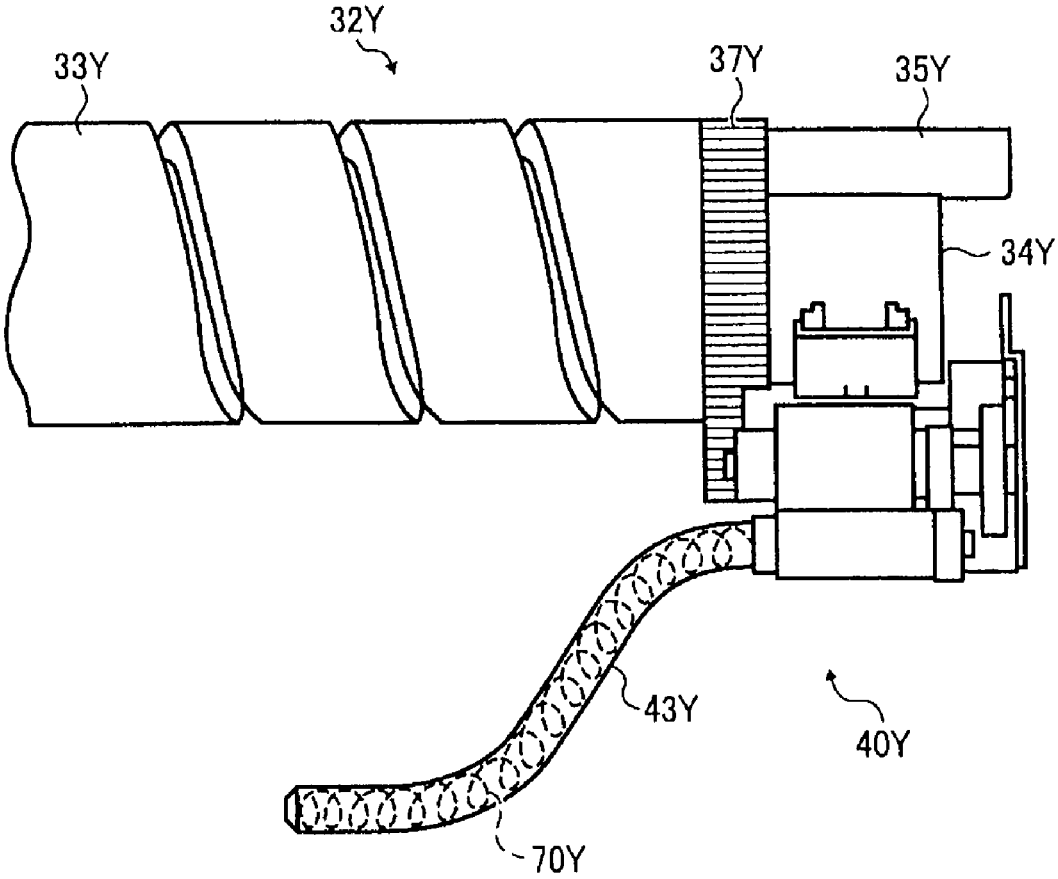
FIG. 8 illustrates an exemplary toner-conveying device for Y use according to one embodiment of the present invention.

The toner conveying device 40Y for Y use as a powder conveyance device is described more in detail with reference to FIG. 8. Specifically, a conveyance coil 70Y serving as a powder conveyance use member is arranged contacting the inner wall of the toner conveyance pipe 43Y serving as a powder conveyance pipe 43Y. A gap between the toner conveyance pipe 43Y and the conveyance coil 70Y is sets to from about 0.1 to about 0.2 mm. In this way, since the conveyance coil 70*y* internally contacts the toner conveyance pipe 43Y, toner attracting to the inner wall of the toner conveyance pipe 43Y receives a movement force in the conveyance direction, accumulation of the toner therein can be suppressed. Thus, a problem that Y toner accumulated in the toner conveyance pipe 43Y is flown into the developing device 5Y at once can be avoided or suppressed.

Further, since a stress of a coil shape against bending force is small, the conveyance coil 70Y can rotate even though the toner conveyance pipe 43Y is bent. Since the toner conveyance pipe 43Y is not necessarily formed straight, a designing freedom increases, and the developing device can be compact.

When a conveyance device includes a screw having a shaft or the like instead of the conveyance coil 70Y, toner can be conveyed in a non-liner conveyance path in a certain situation. However, comparing the shaft inclusion conveyance device with the conveyance use coil, the latter can readily be bent. Thus, a resisting force against deformation, which is caused by rotation at a curvature section of the toner conveyance pipe 43Y, is smaller than when the conveyance use coil is used. Thus, the conveyance coil 70Y can more decrease a slide contact load applied from the toner conveyance pipe 43Y than the shaft inclusion conveyance device.

A first exemplary configuration is now described with reference to FIG. 1. As shown, a space restriction member 60*y* is arranged at a slant section 43*c*Y (e.g. a mostly slanting section in the toner conveyance pipe 43Y) within a hollow section of the conveyance coil 70Y. The outer diameter of the space restriction member 60Y is slightly smaller than the internal diameter of the conveyance coil 70Y, so that a resistance is not created during slide contacting thereto while highly restricting passage of toner. The internal diameter of the conveyance coil 70Y is about 5 mm with tolerance of from 0 to +0.05. The outer diameter of the space restriction member 60Y is about 4.5 mm with tolerance ±0.05.

Further, the space restriction member 60Y is held by a conveyance coil 70Y to rotate together with the conveyance coil 70Y. The space restriction member 60Y can be made of an elastic member, such as sponge, etc., and is held tightly contacting the inner side of the conveyance coil 70Y.

Figure 19:
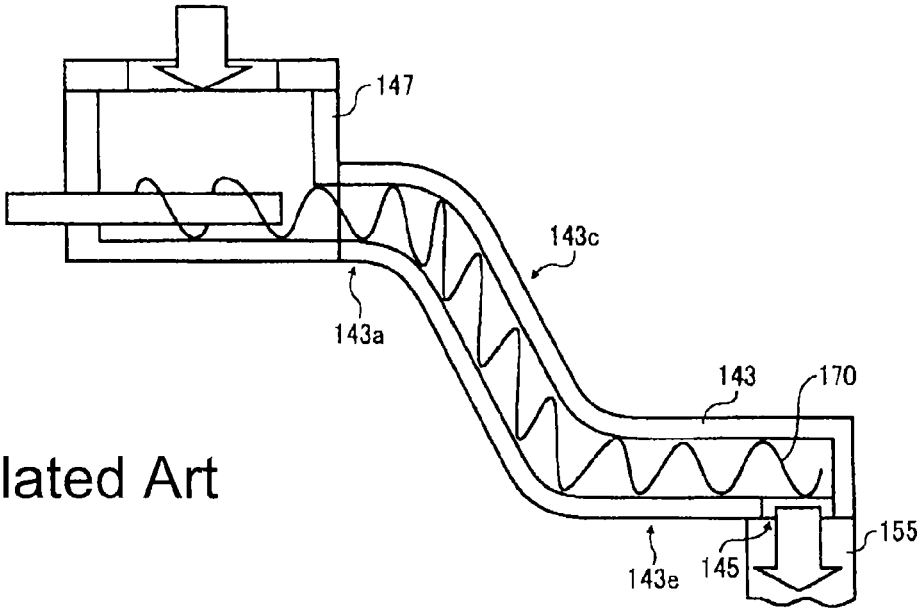
FIG. 19 illustrates a conventional toner conveyance device.

As shown in FIG. 19, in a conventional conveyance toner-conveying device, a space of the slant section of the toner conveyance pipe is almost occupied by air when ordinarily used, and accordingly the air increases fluidity of the toner when toner largely spending images are successively printed.

However, according to this exemplary configuration, by arranging the space restriction member 60Y at the slant section 43*c*Y, an amount of the air decreases and the air is prevented from being excessively blended with the toner by the space restriction member 60Y.

As a result, excessive increase of fluidity of the toner is suppressed.

Further, the higher the rate of space restriction by the space restriction member 60Y at the slant section 43*c*Y in the toner conveyance pipe 43Y, the higher the effectiveness. However, the inventors have confirmed through their experiment that the above-mentioned phenomena can be suppressed without completely evacuating the air by 100% from the slant section 43*c*Y of the toner conveyance pipe 43Y. Specifically, according to their experiment, by decreasing 20% of a cubic volume of the air in the slant section 43*c*Y, the problem of the flowing in can be suppressed. In this exemplary configuration, about 50% of the space of the slant section 43*c*Y is occupied by the space restriction member 60Y.

Since the higher the space restriction rate of the space restriction member 60Y at the slant section 43*c*Y, the smaller a change of an amount of toner conveyance due to fluidity of the toner as time elapses, the higher rate is preferably employed.

Further, in a previous step of occurrence of flowing in of the toner, the toner accumulates at the space of the slant section 43*c*Y usually almost occupied by air compresses, by its weight, the toner existing at the downstream of the toner conveyance pipe 43Y.

However, by restricting the pipe inner space at the slant section 43*c*Y with the space restriction member 60Y, the compression force can be decreased.

Figure 9:
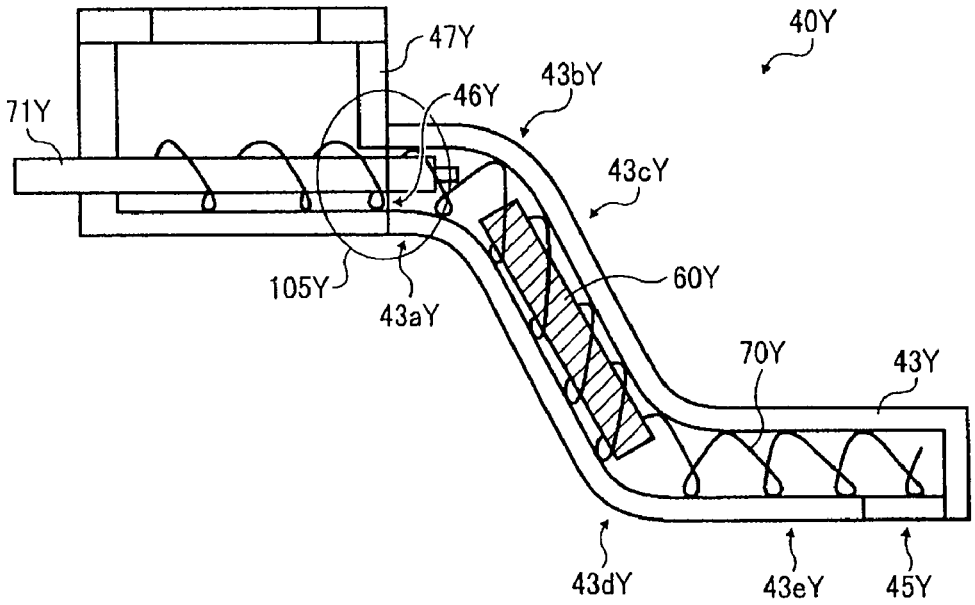
FIG. 9 schematically illustrates a second exemplary toner-conveying device of the present invention.

A second exemplary configuration is now described with reference to FIG. 9. As shown, in addition to the space restriction member 60Y, a passage restriction section 105Y is provided at an upstream side horizontal section 43*a* in the toner conveyance pipe 43Y to effectively restrict passage of the toner.

Replenishment of the toner from the toner bottle 32Y to the toner conveying device 40Y via a toner ejection outlet, not shown, is executed per rotation of the toner bottle 32Y. Since toner replenishment is executed per rotation, an amount of toner replenished at once exceeds that conveyed by the conveyance coil 70Y. The excessive toner flows through a center space of the conveyance coil 70Y and reaches the developing device 5Y regardless of the rotation of the conveyance coil 70Y. Thus, a lot of toner is supplied to the developing device 5Y per rotation of the toner bottle, and density of toner in the developing device 5Y sharply increases and possibly causes a problem, such as background stein, etc.

Figure 10:
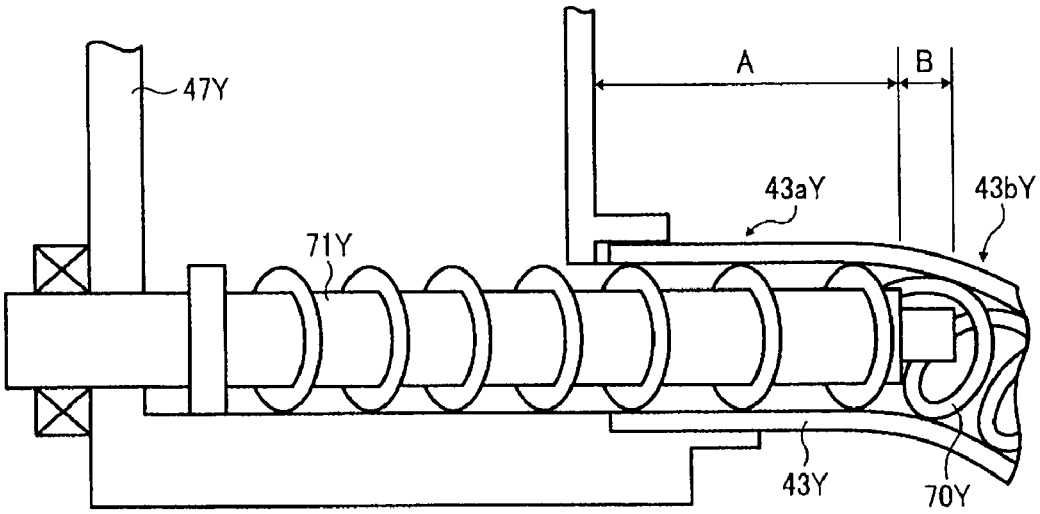
FIG. 10 illustrates exemplary surroundings of a passage restriction section arranged in a toner conveyance device according to the second configuration of the present invention.

Thus, the passage restriction section 105Y has a high performance of restricting an amount of toner passing through the toner conveyance pipe 43Y. In the passage restriction section 105Y, a rotational shaft 71Y is internally adhered to the conveyance coil 70Y. Further, more than one winding of the conveyance coil 70Y is provided in the region A as shown in FIG. 10. Specifically, since the conveyance coil 70Y contacts the inside of the toner conveyance pipe 43Y and the rotational shaft 71Y contacts the inside of the conveyance coil 70Y while more than one winding of the conveyance coil 70Y is provided in the region A, almost no gap exists and the toner can hardly pass through by its own weight. Thus, regardless of a time of ejection of the toner from the toner container 47Y, the flow of the toner is stopped at the region A, and passes only by rotation of the conveyance coil 70Y.

Further, as shown in FIG. 10, a diameter of the rotation shaft 71Y is smaller in the region B downstream of the region A than that of the region A. The leading end of the rotational shaft 71Y extends from the upstream side horizontal section 43*a*Y to almost an inlet where the upstream side curvature section 43*b*Y starts bending. The passage restriction section 105Y is formed from the rotational shaft 71Y and the conveyance coil 70Y. By arranging the passage restriction section 105Y as widely as possible, a performance of restricting passage of toner can be improved. Thus, when the leading end of the downstream side of the rotational shaft 71Y extends almost to the inlet, the passage restriction section 105Y can widely be arranged and a performance of restricting passage of toner can be improved. However, when the diameter of the rotational shaft 71Y is the same as that of the shaft in the region A in the axial direction, the leading end of the downstream side of the rotational shaft 71Y likely interferes with an inner wall of the toner conveyance pipe 43Y in the vicinity of the inlet, the rotational shaft 71Y and the toner conveyance pipe 43Y or the like can be damaged.

Thus, by making the diameter of the rotational shaft 71Y smaller in the region B than that in the region A as shown in FIG. 10, the leading end of the downstream side of the rotational shaft 71Y can avoid interfering with the inner wall of the toner conveyance pipe 43Y in the vicinity of the inlet, while suppressing the damage of the rotational shaft 71Y and the toner conveyance pipe 43Y or the like. Further, the toner passage restriction performance exerted by the rotational shaft 71Y and the conveyance coil 70Y somewhat decreases indeed in the region B. However, since the leading end of the rotational shaft 71 extends up to the region B, the toner conveyance path of the toner conveyance pipe 43Y is narrowed in the region B, toner passage is restricted in proportion to an amount of narrowing.

Further, since the space restriction member 60Y is arranged at the slant section 43*c*Y in this exemplary configuration as in the first exemplary configuration, an amount of air is decreased by the space restriction member 60Y at the slant section 43*c*Y. Thus, excessive blending of the toner with the air, and accordingly, excessive increase of toner fluidity can be suppressed.

Thus, even though the fluidity of the toner excessively increases at the upstream side horizontal section 43*a*Y owing to the above-mentioned reason, the toner is hardly flown into the slant section 43*c*. Even though the toner is flown into the slant section 43*c*Y, since the toner conveyance pipe 43 only includes a small amount of air at the slant section 43*c*Y, the toner is more likely prevents from being excessively blended with the air while fluidity prevents from being excessively increased. Thus, the toner is more hardly flown into the developing device 5Y. In short, a prescribed amount of the toner is more precisely replenished to the developing device 5Y.

Figure 11:
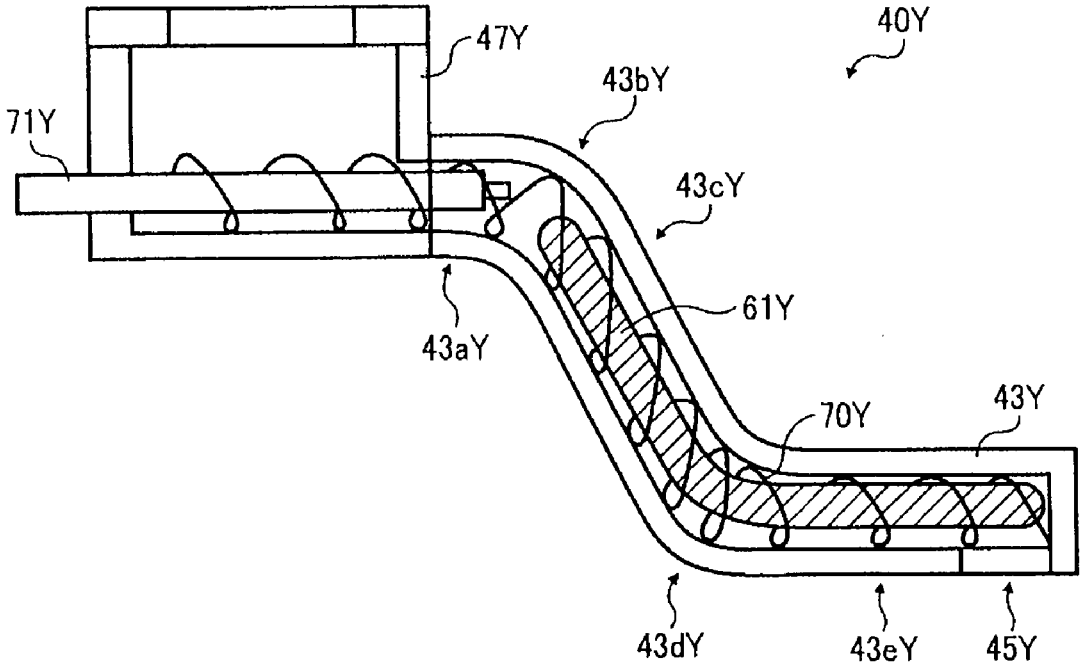
FIG. 11 schematically illustrates a third exemplary configuration of the toner conveyance device of the present invention.

A third exemplary configuration is now described with reference to FIG. 11. As shown, the space restriction member 61Y is arranged extending up to the downstream side horizontal section 43*e*Y of the toner conveyance pipe 43Y via the downstream side curvature section 43*d*Y in addition to the slant section 43*c*Y. Further, the space restriction member 61Y integrally extends from the slant section 43*c*Y to the downstream side horizontal section 43*e*Y. Thus, a cubic capacity (an air capacity) other than a space needed for toner conveyance within the toner conveyance pipe 43Y can be decreased. As a result, the toner is not excessively blended with the air, and excessive increase of the fluidity of the toner can be suppressed in the toner conveyance pipe 43Y.

Since a change of the toner conveyance amount caused by a change of the toner fluidity as time elapses is small in proportion to the rate of the space restriction of the space restriction member 61Y in the toner conveyance pipe 43Y, a higher rate is preferably employed. Specifically, as shown in FIG. 11, the space restriction member 61Y is preferably arranged as long as possible starting from the downstream side horizontal section 43*e*Y to the upstream side of the slant section 43*c*Y.

Figure 12:
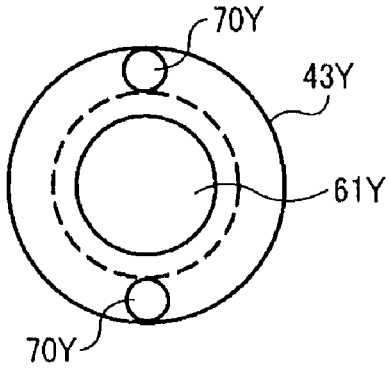
FIG. 12 is a cross sectional view illustrating an exemplary toner conveyance pipe, a conveyance coil, and a space restriction member when viewed in a direction perpendicular to the toner conveyance direction.

Further, the end of the space restriction member 61Y in the toner conveyance direction is either adhered and secured or loosely supported with a clearance by a support section 48Y arranged in the toner conveyance pipe 43Y. Thus, the space restriction member 61Y does not need to tightly internally contact the conveyance coil 70Y and to be held by the conveyance coil 70Y. Further, to suppress excessive increase of the toner fluidity by evacuating the air in the space of the toner conveyance pipe 43Y, a rate of the space restriction member 61Y is preferably 90% of a cross section of the toner conveyance pipe as formed by the internal diameter of the conveyance coil 70Y (i.e., an area drawn by a dotted circular line in the drawing) as shown in FIG. 12.

Now, exemplary toner used in the printer 100 of this embodiment is described. High fluidity toner is used to achieve high-speed toner conveyance. Specifically, an acceleration coagulation degree representing an index of fluidity of the toner is not more than 40%.

A measurement manner of an acceleration coagulation degree is described below. As a measurement device, Powder Tester manufactured by Hosokawa Micron is used. As a measurement manner, a sample as a measurement objective is left as is in a constant-temperature oven (35±2 degree centigrade, 24±1(h)). As a measuring with the powder tester, three types of a minus sieve each having a different mesh (e.g. 75 micrometer, 44 micrometer, 22 micrometer) are used. An coagulation degree is obtained by calculating an amount of toner remaining after using the sieve based on the following calculations:

(Weight of toner remaining on minus sieve of upper step/Amount of extracted sample)×100;

(Weight of toner remaining on minus sieve of middle step/Amount of extracted sample)×100×⅗; and (Weight of toner remaining on minus sieve of lower step/Amount of extracted sample)×100×⅕.

A heating coagulation degree % is obtained by totaling the above listed three calculation values.

Specifically, as mentioned above, the accelerated coagulation degree of the toner represents an index obtained by piling up three types of meshes in an order of a size thereof (texture) and placing particles on the uppermost step while sieving at a prescribed vibration, and then calculating weights of the toner on the meshes, respectively.

When toner of fine fluidity of an accelerated coagulation degree of not more than 40% is used In a conventional toner conveying device as mentioned above with reference to the Japanese Patent Application Laid Open No. 2005-24665, in which flowing of toner from the toner conveying device into the developing device is suppressed, the inside of the toner conveyance pipe 43Y is almost occupied by air. Accordingly, the toner is excessively blended with the air in the toner conveyance pipe 43Y, and the fluidity of the toner excessively increases, and accordingly, the toner is excessively conveyed to the downstream of the toner conveyance pipe 43Y per second. As a result, a lot of developer unavoidably flows into the developing device side, needlessly. In contrast, as mentioned above, according to this exemplary configuration of the toner conveying device 40Y in this embodiment, the space restriction member 60Y and 61Y are arranged in the toner conveyance pipe 43Y and decrease an amount of the air in the toner conveyance pipe 43Y, whereby suppressing excessive blending of the toner with the air. Thus, even though the toner having an accelerated coagulation degree of not more than 40% is used, excessive increase of fluidity of the toner is suppressed in the toner conveyance pipe 43Y, and accordingly, the above-mentioned toner flowing can be suppressed.

Further, in this embodiment, toner having an average round shape degree not less than 0.90 (e.g. from about 0.90 to about 1.00) is employed.

In this embodiment, a value obtained from the following formula defines the round shape degree. The round shape degree represents an index of a degree of unevenness of a toner particle, and is 1.00 when the toner is perfectly a sphere, and is smaller in portion to complexity of a surface shape.

Round shape degree=(Length of circumference having the same area as projected area of particle)/(Length of circumference of projected image of particle) Formula 1;

Since the surface of a toner particle is smooth when an average round shape degree is from 0.90 to 1.00, and a contact area, in which toner particles mutually contact each other or a toner particle contacts a photoconductive member, is small, a transfer performance is excellent.

Since the toner particle does not include a corner, a stirring torque caused by developer in the developing device 5 is small, and an abnormal image is scarcely outputted due to stable drive of stirring.

Since no angular toner particle is included in toner that forms a dot, pressure is uniformly applied to the entire toner forming the dot, and accordingly, transfer error hardly occurs when pressure contacting a transfer medium in a transfer process.

Since the toner particle is not angulous, a grinding force by the toner particle itself is small. Thus, the toner neither damages nor wears the surface of the photoconductive member and the charging member.

Now, an exemplary manner of measuring a round shape degree is described. The round shape degree can be measured by a flow system particle image analysis device FPIA-1000 manufactured by TOA Medical Electronics Co., Ltd.

Specifically, measurement is executed as follows: An amount of 0.1 to 5 ml of interfacial active agent, preferably alkyl benzene sulfonate (ABS), is previously added to an amount of 100 to 150 ml of water stored in a container as a dispersant from which impurity solid substance is removed. Further, amount of about 0.1 to about 0.5 g of sample is added thereto. Suspension with the dispersed sample is then subjected to a dispersion process in an ultrasonic dispersion device for one to three minutes. The shape and granularity of the toner is measured by the above-mentioned device on condition that a dispersion liquid density is from 3000 to 10000 (pieces/micro liter).

To reproduce a fine dot not less than 600 (dpi), the weight average particle diameter (D4) of toner is preferably from three to eight micrometer. In this range, a dot reproduction performance is excellent, because the toner particle has a sufficiently small diameter in relation to a fine latent image dot. When the D4 is not more than 3 micrometer, transfer efficiency and a blade cleaning performance or the like likely decrease.

When the D4 is exceeds 8 micrometer, scattering of characters and lines can be hardly suppressed. A ratio D4/D1 between a weight average particle diameter (D4) and a number average particle diameter (D1) is preferably from 1.00 to 1.40. In proportion to a vicinity level of the ratio to 1.00, a particle diameter distribution is sharp. With such a small particle diameter toner, a charge amount distribution of the toner becomes uniform, and a high quality image excluding background stein can be obtained. Further, the transfer efficiency can be improved in an electrostatic transfer system.

Now, an exemplary method of measuring a granularity distribution of a toner particle is described. As a measurement device measuring granularity distribution of a toner particle using the Coulter counter method, a Coulter counter TA-II, and a Coulter multi counter TA-II, a Multisizer-II (each manufactured by Coulter Co, Ltd.) are exemplified.

Initially, an amount of 0.1 to 5 (ml) of the interfacial active agent, preferably alkyl benzene sulfonate (ABS), is added to an amount of 100 to 150 (ml) of electrolytic aqueous solution as dispersant. The ISOTON-II (manufactured by Coulter Co, Ltd.) can be used as the aelectrolytic aqueous solution, which includes about 1% Nacl aqueous solution prepared using primary natrium chloride. 2 to 20 mg of measurement sample is further added thereto. Electrolysis solution of the sample suspension is subjected to a dispersion process in the ultrasonic dispersion device for one to three minutes. The measurement device measures a weight and a number of pieces of toner particles using an aperture having a size of about 100 micrometer and calculates weight and number of distributions. Based on the distribution obtained, the values D4 and D1 can be calculated.

Thirteen channels of from 2.00 to below 2.52 μm, from 2.52 to below 3.17 μm, from 3.17 to below 4.00 μm, from 4.00 to below 5.04 μm, from 5.04 to below 6.35 μm, from 6.35 to below 8.00 μm, from 8.00 to below 10.08, from 10.08 to below 12.70 μm, from 12.70 to below 16.00 μm, from 16.00 to below 20.20 μm, from 20.20 to below 25.40 μm, from 25.40 to below 32.00 μm, and from 32.00 to below 40.30 μm are used as objectives. Particles having diameter not less than 2.00 micrometer to below 40.30 micrometer are used as objectives.

The toner used in this embodiment is called a polymerization toner, which is obtained by cross-linking and/or causing extension reaction of toner material liquid, which is produced at least by dispersing polyester pre-polymer, polyester, colorant, and mold release having a functional group including nitrogen atom into organic solvent. Exemplary component material of toner and a manufacturing method thereof are described herein below.

Polyester is obtained from polycondensation reaction between multivalent alcohol chemical compound and multivalent carboxylic acid chemical compound. As the multivalent alcohol chemical compound (PO), divalent alcohol (DIO) and more than trivalent alcohol (TO) are exemplified. Amalgam with only DIO or DIO and a small amount of TO is preferable. As the divalent alcohol (DIO), alkyleneglycol, such as ethylene glycol, 1,2-propylene glycol, 1,3-propylene glycol, 1,4-butanediol, hexanediol, etc., alkylene-ether-glycol, such as diethylene glycol, triethylene glycol, dipropylene glycol, polyethylene glycols, polypropylene glycol, polytetra-methylene-ether-glycol, alicyclic-diol, such as 1,4-cyclohexane-dimethanol, hydrogenized-bisphenolA, etc., bisphenol class, such as bisphenol A, bisphenol F, bisphenol S, alicyclic-diol with additament of alkylene-oxide, such as ethylene oxide, propylene oxide, butylenes oxide, and Bisphenol class with additament of alkylene-oxide, such as ethylene oxide, propylene oxide, butylenes oxide, etc., are exemplified. Among these, alkyleneglycol having the carbon number of 2 to 12 and the bisphenol class with additament of alkylene-oxide are preferable used. Simultaneous usage of these is more useful. As the multiple alcohol more than trivalent (TO), (more than 3 to 8) multivalent fatty series alcohol, such as glycerine, trimethylolethane, trimethylolpropane, pentaerythritol, sorbitol, and more than trivalent phenol class, such as tris phenol PA, phenol novolac, cresol novolac, and the more than trivalent phenol class with additament of alkylene-oxide, etc., are preferably used.

As the multivalent carboxylic acid (PC), divalent carboxylic acid (DIC) and more than trivalent carboxylic acid (TC) are exemplified, and the DIC alone and the mixture thereof and the small amount of TC are preferably used. As the divalent carboxylic acid (DIC), Alkylene dicarboxylic acid, such as succinate, adipic acid, sebacic acid, Alkenylene dicarboxylic acid, such as maleic acid, fumarate acid, aromatic series dicarboxylic acid, such as phthalic acid, isophthalic acid, terephthalic acid, naphthalenedisulfonic dicarboxylic acid, etc., are exemplified. Among those, Alkenylene dicarboxylic acid having a carbon number of from 4 to 20 and aromatic series dicarboxylic acid having a carbon number of from 8 to 20 are preferably used. As the more than trivalent carboxylic acid (TC), aromatic series multivalent carboxylic acid having a carbon number of from 9 to 20, such as trimellitic acid, pyromellitic acid, etc., are exemplified. Further, for the multivalent carboxylic acid (PC), acid anhydride of the above-mentioned material or low alkyl ester, such as methyl ester, ethyl ester, isopropyl ester, etc., can be reacted with multivalent alcohol (PO).

A ratio between the multivalent alcohol (PO) and the multivalent carboxylic acid is as follows:

An equivalent ratio OH/COOH between a hydroxyl group OH and a carboxyl group is usually 2/1 to 1/1, preferably, 1.5/1 to 1/1, more preferably, 1.3/1 to 1.02/1. A polycondensation reaction of the PO and the PC is executed as follows:

With the presence of known esterification catalyst, such as tetrabutyltitanate, diButyltin oxide, etc., these are heated up to about 150 to 280 degree centigrade, and produced water is evaporated while reducing the pressure upon need, thereby polyester having hydroxyl group is obtained. The hydroxyl group of the polyester is preferably more than five, and acid number of the polyester is generally from 1 to 30, preferably from 5 to 20. Due to the acid number, a charge performance tends to be negative and affinity between the printer sheet and toner is fine while a low temperature fixing performance is improved when a fixing process is executed onto a printing sheet. However, when the acid number exceeds 30, charge stability tends to deteriorate in response to a change of environment. Further, weight-average molecular weight ranges from 10 to 400 thousand, preferably, 20 to 200 thousands. When weight-average molecular weight is less then 10 thousands, offset resistance performance deteriorates. When 400 thousand is exceeded, the low temperature fixing performance deteriorates.

Polyester preferably includes not modified Polyester obtained by the above-mentioned polycondensation reaction, and Urea modified Polyester. To obtain the Urea modified Polyester, carboxyl group of the tail end of the Polyester obtained by the above-mentioned polycondensation reaction and hydroxyl group or the like are reacted with the multivalent isocyanate chemical compound (PIC), thereby Polyester prepolymer (A) having the isocyanate group is produced. Then, by reacting the hydroxyl group or the like (A) with amine class, a molecular chain is cross-linked and/or extended.

As the multivalent isocyanate chemical compound (PIC), fatty series multivalent isocyanate, such as tetramethylene di-isocyanate, hexamethylene diisocyanate, 2,6-di-isocyanate methylcaproate, alicyclic polyisocyanate, such as Isophorone Diisocyanate, cyclohexyl methane di-isocyanate, aromatic series di-isocyanate, such as Tolylene diisocyanate, diphenylmethane diisocyanate, aromatic fatty series di-isocyanate, such as α,α,α',α'-tetramethylenexylylene di-isocyanate, Isocyanate class, such as polyisocyanate blocked by phenol derivatives, oxime, caprolactam, or the like, and simultaneous use of at least two of the above mentioned material are exemplified.

A ratio of the multivalent isocyanate chemical compound (PIC) is as follows:

An equivalent ratio NCO/OH between an isocyanate group NCO and a polyester hydroxyl group OH having a hydroxyl group is generally 5/1 to 1/1, preferably, 4/1 to 1.2/1, more preferably, 2.5/1 to 1.5/1. However, when the ratio NCO/OH exceeds 5, a low temperature fixing performance deteriorates. When a mole ratio is less than 1 and the Urea modified Polyester is used, urea content decreases, and unit hot offset performance deteriorates.

The content of a component of the (PIC) included in the polyesterprepolymer (A) having the isocyanate group is usually 0.5 to 40 weight %, preferablyl to 30 weight %, and more preferably 2 to 20 weight %. When the content is less than 0.5 weight %, both of the heat resistance storage stability and low temperature fixing performances are hardly satisfied and hot offset resistance performance deteriorates. When 40 weight % is exceeded, the low temperature fixing performance deteriorates.

Ordinarily, more than one, preferably 1.5 to 3, more preferably 1.8 to 2.5 items of the isocyanate group are included in the polyesterprepolymer (A) having the isocyanate group per molecule. When less than one piece is included per a molecule, a molar weight of the Urea modified Polyester decreases, and accordingly, the hot offset resistance performance deteriorates.

Further, as the amine class B to be reacted with the polyesterprepolymer A, Divalent amine chemical compound B1, more than trivalent amine chemical compound B2, amino alcohol B3, amine mercaptan B4, amine acid B5, and the material (B6) obtained by blocking amine groups of amino group B1 to B5 are exemplified.

As the divalent amine chemical compound B1, aromatic diamine, such as phenylenediamine, diethyltoluenediamine, 4,4'-diamino diphenylmethane, alicyclic diamine, such as 4,4'-diamino, 3,3'-dimethyl dicyclo hexyl methane, diamine cyclohexane, Isophorone Diamine, aliphatic diamine, such as ethylene diamine, tetramethylendiamine, hexamethylene diamine, etc., are exemplified.

As the more than trivalent amine chemical compound B2, diethylenetriamine, triethylenetetramine, etc., are exemplified. As the amino alcohol B3, ethanolamine, hydroxyethyl aniline, etc., are exemplified. As the amino-mercaptan B4, amino-ethyle mercaptan, amino-propyl mercaptan, etc., are exemplified.

As the amino acid B5, amino propional acid, aminocaproic acid, etc., are exemplified. As the material (B6) blocking the amino group, ketimine chemical compound, oxazolidine chemical compound obtained from the amino groups of the above-mentioned B1 to B5 and ketone class, such as acetone, methyl ethyl ketone, methyl isobutyl ketone, etc., are exemplified. Among those amine class B, the B1 and the mixture of the B1 and a small amount of the B2 are preferably used. The ratio of the amine class B is as follows:

An equality ratio NCO/NHx between the isocyanate group NCO included in the polyesterprepolymer A having the isocyanate group and the amine group NHx included in the amine class is usually 1/2 to 2/1, preferably 1.5/1 to 1/1.5, further preferably 1.2/1 to 1/1.2.

When the ratio NCO/NHx exceeds two or is less than 1/2, a molar weigh of urea modified polyester decreases and a hot offset resistance performance deteriorates. The urea-modified polyester can include urea combination and urethane combination. A mole ratio between the urea combination content and the urethane combination content is unusually 100/0 to 10/90, preferably 80/20 to 20/80, more preferably 60/40 to 30/70. When the mole ratio of the urea combination is less than 10%, a hot offset resistance performance deteriorates.

The urea modified polyester is produced using a one shot method or the like. With the presence of known esterification catalyst, such as tetrabutyltitanate, diButyltin oxide, etc., the material PO and PC are heated up to about 150 to 280 degree centigrade, and water thus produced is evaporated while reducing the pressure upon need, thereby polyester having hydroxyl group is obtained. Then, at 40 to 140 degree centigrade, the multivalent isocyanate (PIC) is reacted therewith, and the polyester prepolymer (A) having the isocyanate group is obtained. Then, at 0 to 140 degree centigrade, the amine class B is reacted with the A and the urea modified polyester is obtained.

When the PIC, as well as the material A and B are reacted, solvent can be used upon need. As the usable solvent, aromatic series solvent, such as toluene, xylene, ketone class, such as acetone, methyl ethyl ketone, methyl isobutyl ketone, ester class, such as ethyl acetate, amide class, such as dimethylformamide, dimethylacetamide, and ether class, such as tetrahydrofuran, each chemically stable against the isocyanate (PIC), are exemplified.

Further, to execute cross-linkage and/or extension reaction of the polyester prepolymer A and the amine class B, reaction stopping agent is used upon need and a mole weigh of urea modified polyester obtained can be adjusted. As the reaction-stopping agent, monoamine, such as diethylamine, dibutylamine, butyl amine, lauryl amine, and material obtained by blocking these, such as ketimine chemical compound, etc., are exemplified.

The weight average molar weight of the urea modified polyester is generally more than ten thousand, preferably, 20 thousand to 10 million, more preferably, 30 thousand to 10 million. When less than 10 thousand, the hot offset resistance performance deteriorates. Various number average molar weights of the urea-modified polyester can be used as far as it is readily obtained to calculate the weight average molar weight especially when not modified polyester is used. When the urea modified polyester is used alone, the number average molar weight is generally from 2000 to 15000, preferably 2000 to 10000, more preferably 2000 to 8000. When 20000 is exceeded, the low temperature performance and brilliance performance deteriorate when used in a full color system.

It is more preferable to simultaneously use the not modified polyester and the urea modified polyester. Because, the low temperature performance and brilliance performance are improved when used in the printer 100 more than when the urea modified polyester is only used. The not modified polyester can include polyester modified by chemical combination other than the urea combination.

The not modified polyester and the urea-modified polyester are preferably at least partially miscible with each other in view of the low temperature fixing performance and hot offset resistance performance. Accordingly, the not modified polyester and the urea-modified polyester preferably have similar composition to each other.

The weight ratio between the not modified polyester and the urea-modified polyester is usually from 20/80 to 95/5, preferably 70/30 to 95/5, and more preferably 75/25 to 95/5, yet more preferably 80/20 to 93/7. When the weight ratio is less than 5%, both of the heat resistance storage stability and low temperature fixing performances are hardly simultaneously satisfied while hot offset resistance performance deteriorates.

A glass transition point (Tg) of binder resin including the not modified polyester and the urea-modified polyester is generally from 45 to 65 degree centigrade, preferably from 45 to 60 degree centigrade.

When 45 deg centigrade is not exceeded, the heat resistance deteriorates. When 65 degree centigrade is exceeded, the low temperature fixing performance is insufficient.

In comparison with the known polyester toner, since the urea modified polyester is readily able to stay on the surface of the obtained toner parent particle, the urea modified polyester can show fine heat resistance even having the low glass transition point.

As a colorant, all of known dye and pigment can be used, such as carbon black, nigrosine dye, iron black, naphthol yellow S, hansa yellow (10G, 5G, G), cadmium yellow, yellow ferric oxide, yellow ocher, chrome yellow, titanium yellow, polyazo yellow, oil yellow, hansa yellow (GR, A, RN, R), pigment yellow L, benzidine yellow (G, GR), permanent yellow (NCG), vulcanfast Yellow (5G, R), tartrazin lake, quinoline yellow lake, anthracene yellow BGL, isoindoline Yellow, colcothar, red lead oxide, lead vermillion, cadmium red, cadmium Mercury-Red, stibium red, permanent red 4R, Para Red, fire red, parachlororthonitroaniline red, Lithol fast Scarlet G, Brilliant fast Scarlet, Brilliant Carmine BS, permanent red (F2R, F4R, FRL, FRLL, F4RH),fast Scarlet VD, belkan fast Rubin B, Brilliant fast Scarlet G, Lithol Rubin GX, permanent redF5R, Brilliant Carmine 6B, pigment Scarlet 3B, Bordeaux 5B, Toluidine Maroon, F2K permanentoner bottlerdeauxF2K, helio Bordeaux BL, Bordeaux 10B, BonMaroon light BonMaroon Medium, eo Ysin lake, rhodamine lake B, rhodamine lake Y, alizarine lake, thioindigo red B, thioindigo Maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, Indanthrene blue, indigo, ultramarine blue, iron blue pigment, anthraquinone blue, fast violet B, methyl violet lake, cobalt violet, manganese violet, dioxane violet, anthraquinone violet, chrome green, zinc green, chrome oxide, viridian, emerald green, pigment green B, naphthol green B, green gold, acid green lake, malachite green lake, phthalocyanine green, anthraquinone green, titanium oxide, zinc oxide, and Lithopone and mixture of those, etc.

The content of the colorant is usually from 1 to 15-weight % of toner, preferably, from 3 to 10 weight % thereof.

The colorant can also be used as a master patch combined with resin. As binder resin producing the master patch or being stirred and blended with the master patch, styrene, such as polystyrene, poly-p-chlorostyrene, polyvinyl toluene, and its polymer of derivative substitution of the styrene, or copolymer of vinyl compound and those materials, polymethyl methacrylate, polybutyl methacrylate polyvinyl chloride, polyvinyl acetate, polyethylene resin, polypropylene, polyester, epoxide resin, polyol polyol resin, polyurethane, polyamide, polyvinyl butyral, polyacrylic acid resin, rosin, modified rosin, terpene resin, fatty series or alicyclic molecule carbon hydrid resin, aromatic series petroleum resin, chlorinated paraffin, paraffin wax are exemplified. These can either be use alone or being blended.

As charge control agent, known material can be used. For example, nigrosine dye, triphenylmethane dye, chrome inclusion metal-complex compound dye, molybdic acid chelate pigment, rhodamine dye, alkoxy amine, fourth degree ammonium salt including fluorine modified fourth degree ammonium salt alkylamido, phosphor simple substance or chemical compound, tungsten simple substance or chemical compound, fluorine activation, salicylic acid metal salt, and salicylic acid derivatives metal salt can be used. Specifically, nigrosine dye Bontron™ 03, fourth degree ammonium salt Bontron P-51, metal inclusion azo dye bontron S-34, oxynaphthoic acid metal-complex E-82, salicylic acid metal-complex E-84, phenol condensate E-89 (heretofore, manufactured by Orient Chemical Industry Co, Ltd), fourth degree ammonium salt molybdic complex TP-302 and TP-415 (heretofore, manufactured by Hodogaya Chemical Industry Co, Ltd), copy charge PSY VP2038 of fourth degree ammonium salt, copy blue PR of triphenylmethane derivative, copy charge NEG VP2036 of fourth degree ammonium salt, copy charge NX VP434 (heretofore, manufactured by Hoechst Co, Ltd), LRA-901, LR-147 as boron complex (manufactured by Japan Carlit Co, Ltd), copper phthalocyanine, perylene, quinacrine, azo pigment, sulfonic acid group, carboxyl group Chemical compound of polymer molecule having functional moiety such as fourth degree ammonium salt can be used. Among these, substance controlling toner to have a negative polarity is preferably used.

An amount of usage of charge control agent is not limited to one, but is determined in accordance with a type of binder resin, presence or absence of additives used upon need, and a toner-manufacturing manner including a dispersion manner. For example, the usage amount preferably ranges from 0.1 to 10, more preferably, 0.2 to 5 weight part. When 10-weight part is exceeded, a charge amount of toner is excessive, and accordingly, efficiency of the charge control agent deteriorates. As a result, electrostatic absorption force caused between the developing roller and the toner increases, and fluidity of the developer decreases, and further image density deteriorates.

As a releasing agent, low melting point wax having a melting point at about from 50 to 120 degree centigrade is used more preferably effectively work between the fixing roller and the toner boundary face when dispersed into a binder resin. Thus, the low melting point wax is effective in view of the high temperature off set, because the fixing roller does not need a release agent such as oil, etc. The below described wax component can be employed. Specifically, as wax, plant wax, such as carnauba wax, cotton wax, wood wax, rice wax, etc., animal wax, such as yellow beeswax, lanoline, etc., mineral wax, such as ozokerite, serisin, Petroleu wax, such as paraffin, microcrystalline, petrolatum, etc, are exemplified. Further, beside these natural wax, synthetic carbon hydride wax, such as Fischer-Tropsch wax, polyethylene wax, etc., and synthetic wax, such as ester, ketone, ether, etc., are exemplified. Further, fatty acid amide, such as crystal giant molecule having a long alkyl group as a lateral chain, such as hydroxyl 12-stearic acid amide hydroxystearate, stearic acid amide, phthalic anhydride imide, chlorinated hydrocarbon, etc., and homopolymer of polyacrylate, such as copolymer of n-stearyl acrylate ethyle methacrylate, etc., serving as a low-molecular weight crystalline giant molecule resin, or copolymer thereof, such as poly-n-stearyl methacrylate, poly-n-lauryl methacrylate, etc., can be used.

The charge control agent and the mold release agent can be melt and blended together with master batch and binder resin, and can be added when melted and dispersed into organic solvent.

As an external Additive, a nonorganic fine particle is used to help support fluidity, developing performance, and charge performance of toner particle. A diameter of a primary particle of the nonorganic fine particle is preferably $5\times10^{-3}$ to 2 micrometer, more preferably, $5\times10^{-3}$ to 0.5 micrometer. Further, a specific surface measured by the BET method is preferably 20 to 500 ($m^2/g$). A usage rate of this inorganic fine particle is 0.01 to 5 weight percent of toner.

As the inorganic fine particle, silica, alumina, titanium oxide, barium titanate, magnesium titanate, calcium titanate, strontium titanate, zinc oxide, tin oxide, silica sand, clay, isinglass, sand-lime stone, diatom earth, chrome oxide, cerium oxide, colcothar, antimony trioxide, magnesium oxide, zirconium oxide, barium sulfate, barium carbonat, calcium carbonate, silicon carbide, and silicon nitride or the like can be exemplified. As the fluidity adding agent, hydrophobic silica fine particle and hydrophobic titanium oxide fine particle are preferably used at the same time among those. In particular, when both of them each having average particle diameter of $5\times10^{-2}$ micrometer are blended and mixed, both of an electro static force created with toner and the van der Waals force dramatically increase, and accordingly, the fluidity addition agent does not separate from the toner even if stirred and blended in the developing device 5 for the purpose of obtaining a prescribed charge degree. As a result, a fine image quality is obtained excluding erroneous white dots on the image, and toner remaining after the transfer decreases.

The titanium oxide fine particle is excellent in environmental safety and image density stability. However, due to tendency of deterioration of charge rising performance, when the titanium oxide fine particle addition amount increases more than silica fine particle addition amount, this ill influence becomes serious.

However, when the additional amount of the hydrophobic silica fine particle and the hydrophobic titanium oxide fine particle is within 0.3 to 1.5-weight %, the charge rising performance does not largely deteriorate, and accordingly, a prescribed charge rising performance can be obtained. Thus, the stable image quality can be obtained during repeat copying.

Now, an exemplary toner manufacturing method, but is not limited thereto, is described.

First, colorant, not modified polyester, polyester prepolymer having isocyanate group, and releasing agent are dispersed into organic solvent, thereby toner material liquid is produced. The organic solvent preferably has a volatile performance with a boiling point of less than 100 degree centigrade in view of ease of removal after formation of toner parent particle. Specifically, One of or appropriate combination of toluene, xylene, benzene, carbon tetrachloride, dichloromethan, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone are used. Especially, aromatic series solvent, such as toluene, xylene, etc., and halogenated hydrocarbon, such as dichloromethane, 1,2-dichloroethane, chloroform, carbon tetrachloride, etc., are preferably used among those. A usage amount of the organic solvent is typically from zero to 300 weight part, preferably from zero to 100 weight part, more preferably from 25 to 70 weight part in relation to a polyester prepolymer 100 weight part.

Second, toner material liquid is subjected to emulsification in a drainage texture medium with the presence of interfacial active agent and resin fine particle. The drainage texture medium can include only water, or organic solvent such as alcohol (e.g. methanol, isopropyl alcohol, ethylene glycol), dimethylformamide, tetrahydrofuran, cellusolve class (e.g. methyl cellusolve), low ketone (e.g. acetone, methyl ethyl ketone), etc.

A usage amount of the drainage texture medium is typically from 50 to 2000 weight parts, preferably 100 to 1000 weight parts in relation to the toner material liquid 100-weight part. Specifically, in the case the 50-weight part is not exceeded, the toner material liquid is not preferably dispersed, and accordingly, a toner particle having a prescribed diameter cannot be obtained. In the case 20000-weight part is exceeded, it is wasteful.

Further, to appropriately execute dispersion in the drainage texture medium, dispersant, such as interfacial active agent, resin fine particle, etc., is appropriately added. As the interfacial active agent, anion interfacial active agent, such as alkyl benzene sulfonate, alfa-olefin sulfonate, phosphate ester, etc., amine salt type, such as alkylamine salt, etc., aminoalcohol fatty acid derivatives, polyamineatty acid derivatives, imidazoline, fourth ammonium salt type cation interfacial active agent, such as alkyltrimethylammonium salt, dialkyl dimethyl ammonium salt, dialkyl dimethyl benzil ammonium salt, pyridinium salt, alkyl isoquinolinium salt, benzethonium chloride, etc., non-ion interfacial active agent, such as fatty acid amide derivatives, multivalent alcohol derivatives, etc., and ampholyte interfacial active agent, such as alanine, dodecyldi(aminoethyl)glycine, di(octylaminoethyl)glycine, N-alkyl-N,N-dimethyl ammonium betaine, etc., can be used.

Further, even if an extraordinary small amount of the interfacial active agent including fluoroalkyl group is used, the expected effect can be obtained. As the anion interfacial active agent having the fluoroalkyl group preferably used, fluoro alkylcarboxylic acid having carbon number from 2 to 10 and its metal salt, perfluoro octane sulfonyl glutamic acid disodium, 3-(ω-fluoroalkyl(C6-C11)oxy)-1-alkyl(C3-C4) sulfonic natrium, 3-(ω-fluoroalkanoyl(C6-C8))-N-ethylamino)-1-propane sulfonic natrium, fluoroalkyl(C11-C20) carboxylic acid and its metal salt, perfluoroalkyl carboxylic acid (C7-C13) and its metal salt, perfluoroalkyl(C4-C12)sulfonic acid and its metal salt, perfluoro octane sulfonic acid diethanol amide, N-propyl-N-(2-hydroxyethyl)perfluoro octane sulfonic amide, perfluoroalkyl(C6-C10)sulfonic amide propyl trimethylammonium salt, perfluoroalkyl(C6-C10)-N-ethyl sulfonyl glycine salt, and mono-perfluoroalkyl (C6-C10)ethyl phosphate ester are exemplified.

As a commodity, SURFLON® S-111, S-112 and S-113 produced by Asahi Glass Co, Ltd., FLUORAD FC-93, FC-95, FC-98, and FC-129 (produced by Sumitomo 3M Co, Ltd.), UNIDAIN DS-101 and DS-102 (produced by Daikin Industrial Co, Ltd.), MEGAFACKF-110, F-120, F-113, F-191, F-812 and F-833 (produced by Dainihon Inki Co, Ltd.), EFTOP EF-102, 103, 104, 105, 112, 123A, 123B, 306A, 501, 201, 204 (produced by Tohchem products Co, Ltd.), and HUTARGENT F-100 and F150 (produced by NeOS Co, Ltd.) are exemplified.

Further, as the cationic interfacial active agent, first and second fatty series having fluoroalkyl group, second amine acid, fourth fatty series ammonium salt such as perfluoroalkyl (C6-C10)sulfone amide propyltrimethylammonium salt, etc., benzal conium salt, benzethonium chloride, pyridinium salt, and imidazolium salt are exemplified. As a commodity, SURFLON® S-121 produced by Asahi Glass Co, Ltd, FLUORAD FC-135 produced by Sumitomo 3M Co, Ltd., UNIDAIN DS-202 produced by Daikin Industrial Co, Ltd., MEGAFACK F-150 and F-824 produced by Dainihon Inki Co, Ltd., EFTOP EF-132 produced by Tohchem products Co, Ltd., and HUTARGENT F-300 produced by NeOS Co, Ltd, are exemplified.

A resin fine particle is added to stabilize a toner parent particle produced in a drainage texture. Thus, the resin fine particle is preferably added so that coverage thereof on the surface of the toner parent particle is from 10 to 90%. For example, polymethacrylic acid methyle fine particle having a size of 1 micrometer or 3 micrometer, polystyrene fine particle having a size of 0.5 micrometer and 2 micrometer, and poly(styrene-acrylonitrile) fine particle having a size of 1 micrometer are exemplified. As a commodity, PB-200H (produced by Kao Co., Ltd), SGP (produced by Soken Chemical & Engineering Co., Ltd.), TECHNOPOLYMER SB (produced by Sekisui Plastics Co., Ltd.), SGP-3G (produced by Soken Chemical & Engineering Co., Ltd.), and MICRO PEARL (produced by Sekisui Fine Chemical Co., Ltd.) or the like are used.

Further, inorganic compound dispersant, such as tricalcium phosphate, calcium carbonate, titanium oxide, colloidal silica, hydroxyapatite, etc., can be used.

Droplet of dispersant can be stabilized by giant molecule protection chorioid and used together with the above-mentioned resin fine particle and the inorganic chemical compound dispersant. For example, acidum class, such as acrylic acid mathacrylic acid, α-cyanoacrylic acid, α-cyanomathacrylic acid,itaconic acid, crotonic acid, fumaric acid, maleic acid maleic anhydride, etc., (meta)acrylic monomeric substance having hydroxyl, such as acrylic acid-β-hydroxyethyl, mathacrylic acid-β-hydroxyethyl, acrylic acid-β-hydroxypropyl, mathacrylic acid-β-hydroxypropyl, acrylic acid-γ-hydroxypropyl, mathacrylic acid-γ-hydroxypropyl, acrylic acid-3-chloro-2-hydroxypropyl, mathacrylic acid-3-chloro-2-hydroxypropyl, diethylene glycol monoacrylic acid ester, diethylene glycol monomathacrylic acid ester, glycerin monoacrylic acid ester, glycerin monomathacrylic acid ester, N-methylol acrylamide, N-methylol compound of those, etc., acid chloride class, such as acrylic acid chloride, mathacrylic acid mathacrylicamide vinyl alcohol class or ether class with vinyl alcohol, such as vinylmethyl ether, vinylethylether, vinylpropylether, etc., ester class of compound including vinyl alcohol and carboxyl group, such as vinyl acetate, propionic acid vinyl, butyric acid vinyl, acrylamide, mathacrylicamide, diacetoneacrylamide, methylol chloride, etc., nitrogen-containing compound, such as vinylpyridine, vinylpyrrolidone, vinylimidazole, ethyleneimine, etc., or homopolymer or copolymer including heterocycle of those, polyoxyethylene series, such as polyoxyethylene, polyoxypropylene, polyoxyethylene alkylamine, polyoxypropylene alkylamine, polyoxyethylene alkylamido, polyoxypropylene alkylamido, polyoxyethylene-nonyl-phenyl ether, polyoxyethylene-lauryl-phenyl ether, polyoxyethylene stearyl phenyl ether ester, polyoxyethylene nonyl-phenyl ester, etc., and cellulose class, such as methylcellulose, hydroxyethylcellulose, hydroxypropylcellulose, etc., can be used.

A dispersion system is not limited to, but known systems, such as a low speed shearing system, a high speed shearing system, a friction system, a high pressure jet system, a supersonic system, etc., can be employed. Among those, the high-speed shearing system is preferably used to obtain a particle of a dispersing element having a diameter of from 2 to 20 micrometer. When a high-speed shearing system dispersion machine is used, an rpm is not limited to, but is usually from 1000 to 30000, preferably, 5000 to 20000. A dispersion time is not limited to, but is usually from 0.1 to 5 minutes when a batch processing system is used. As temperature during the dispersion is generally from zero to 150 degree centigrade (under pressure), preferably from 40 to 98 degree centigrade.

Third, amine class (B) is added at the same time when emulsified liquid is produced to react with polyesterprepolymer (A) having an isocyanate group. Cross-linkage and/or expansion of a molecular chain accompanies this reaction. A reaction time period is selected in accordance with a reaction performance between the structure of the isocyanate group included in the polyesterprepolymer (A) and the amine class. It is generally from 10 minutes to 40 hours, preferably 2 to 24 hours. The reaction temperature is generally from zero to 150 degree centigrade, preferably from 40 to 98 degree centigrade. Upon need, a known catalyzer, such as Butyltinlaurate, Dioctyltin laurate, etc., can be used.

Fourth, when the reaction completes, the organic solvent is removed from the emulsion-dispersing element (i.e., reaction substance), and the reaction substance is washed and is dried. Thus, the parent particle is obtained. To remove the organic solvent and produce a spindle shape parent toner particle, the entire series is gradually heated up in a laminar flow stirring condition, and is intensely stirred at a constant temperature. The solvent is then extracted. When an acid such as calcium phosphate or a substance dissolvable with alkalis is used as a dispersion stabilizer, calcium phosphate acid is removed from the toner parent toner particle first by dissolving the calcium phosphate acid with acid such as hydrochloric acid and then washing with water. Otherwise, the calcium phosphate acid can be removed by resolving with ferment.

Fifth, charge control agent is struck into the toner parent toner particle, and inorganic fine particle, such as silica, titanium oxide, etc., is then external added thereto, whereby toner is obtained. Striking of the charge control agent and external addition of the inorganic fine particle is executed by a known method using a mixer or the like. As a result, even toner having a small particle diameter and sharp particle distribution can readily be obtained. Further, by providing intense stirring in the step of removing the inorganic solvent, various shapes from a sphere shape to a rugby ball shape can be obtained. Further, morphology of the surface can be controlled from smooth one to a pickled plum shape.

In accordance with the above-mentioned various configurations in this embodiment, unfavorable toner flowing can be suppressed even if the above-mentioned toner is used in the conventional toner conveyance device as discussed in the Japanese Patent Application Laid Open No. 2005-24665.

Now, a second embodiment of an exemplary printer 100 employing an electrophotographic system is described. The fundamental configuration and toner used in the printer 100 is as same as that in the first embodiment. Thus, their description is omitted.

Figure 13:
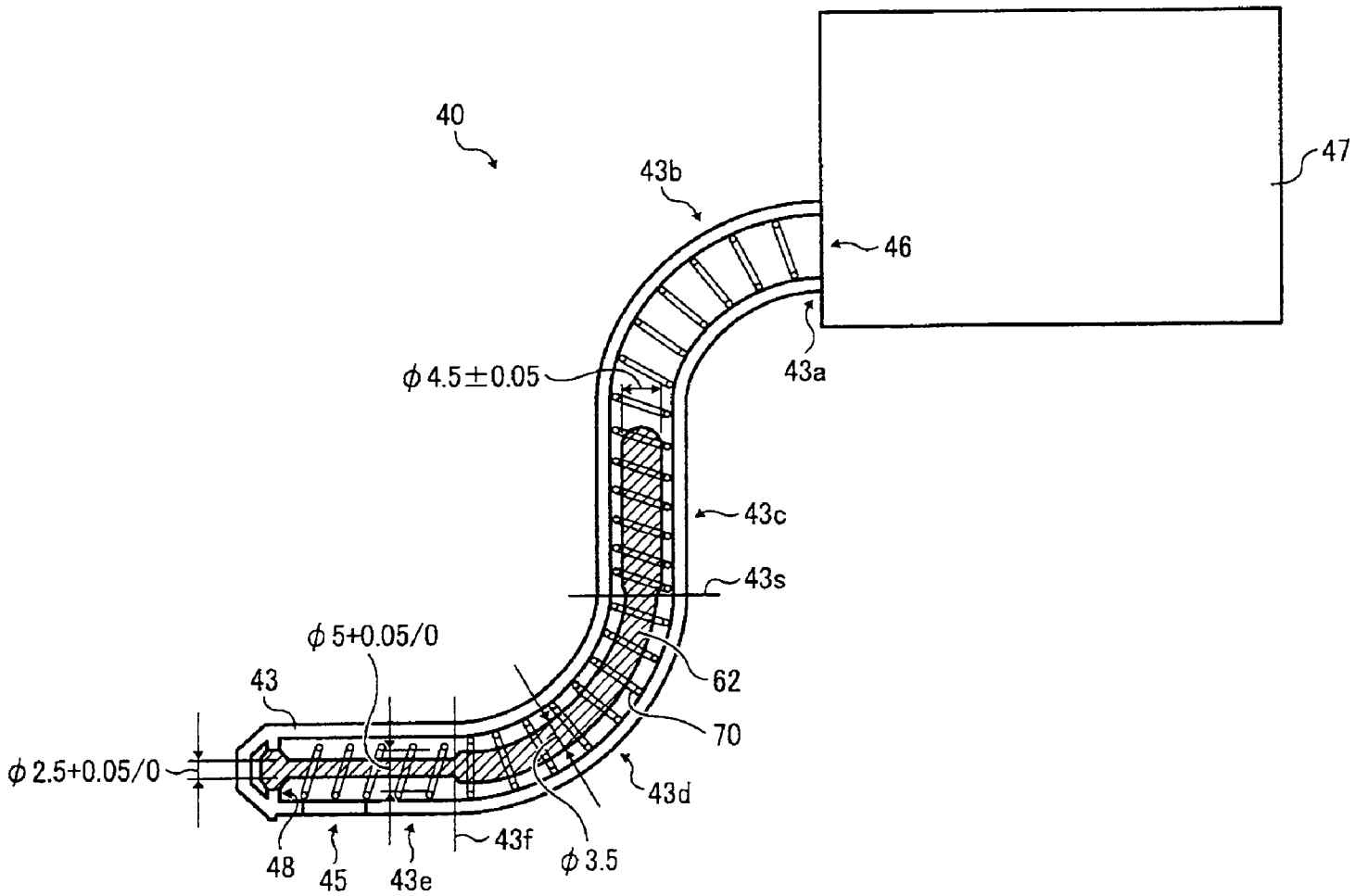
FIG. 13 schematically illustrates a fourth exemplary configuration of the toner conveyance device of the present invention.

A fourth exemplary configuration is initially described with reference to FIG. 13. As shown, a space restriction member 62 is arranged from a downstream side horizontal section 43*e* to a slant section 43*c* of the toner conveyance pipe 43. An end of the space restriction member 62 in a downstream side in the toner conveyance direction is either adhered and secured or loosely supported with a clearance by a support section 48 arranged in the toner conveyance pipe 43. Further, a conveyance coil 70 is arranged between the internal wall of the toner conveyance pipe 43 and the space restriction member 62. The outer diameter of the space restriction member 62 of the toner conveyance pipe 43 is slightly smaller at the slant section 43*c* than the internal diameter of the conveyance coil 70, so that a resistance is not created at the time of contact sliding while highly restricting passage of the toner. In this exemplary configuration, the internal diameter of the conveyance coil 70 is about 5 mm with tolerance of from 0 to +0.05. The outer diameter of the space restriction member 62 is about 4.5 mm with tolerance of ±0.05 at the slant section 43*c*.

In the conventional toner-conveying device, a space of a toner conveyance pipe at the slant section is almost occupied by air as shown in FIG. 19. Thus, when a toner largely spending image is successively printed, the air improves fluidity of the toner by excessively blending with the toner. Then, according to this exemplary configuration, by arranging the space restriction member 62 from the downstream horizontal section 43*e* to the slant section 43*c*, an amount of the air in the space from the downstream side horizontal section 43*e* to the slant section 43*c* is decreased by the space restriction member 62. As a result, excessive increase of the toner fluidity caused by the excessive blending of the air with the toner can be suppressed.

Further, to keep a space for toner to accumulate in the vicinity of the a replenishment inlet 45 at the downstream side horizontal section 43*e*, the outer diameter of the space restriction member 62 is smaller at the downstream side horizontal section 43*e* than that at the slant section 43*c*. Specifically, a gap between the space restriction member 62 and the inner wall of the toner conveyance pipe 43 at the downstream side horizontal section 43*e* is not less than 1 mm. As shown in FIG. 13, the internal diameter of the conveyance coil 43 is about 7 mm with tolerance of from +0.1 to +0.5. The outer diameter of the space restriction member 62 at the slant section 43*c* is about 4.5 mm with tolerance ±0.05. The outer diameter of the space restriction member 62 at the downstream side horizontal section 43*e* is about 2.5 mm with tolerance of from 0 to +0.05.

Figure 14:
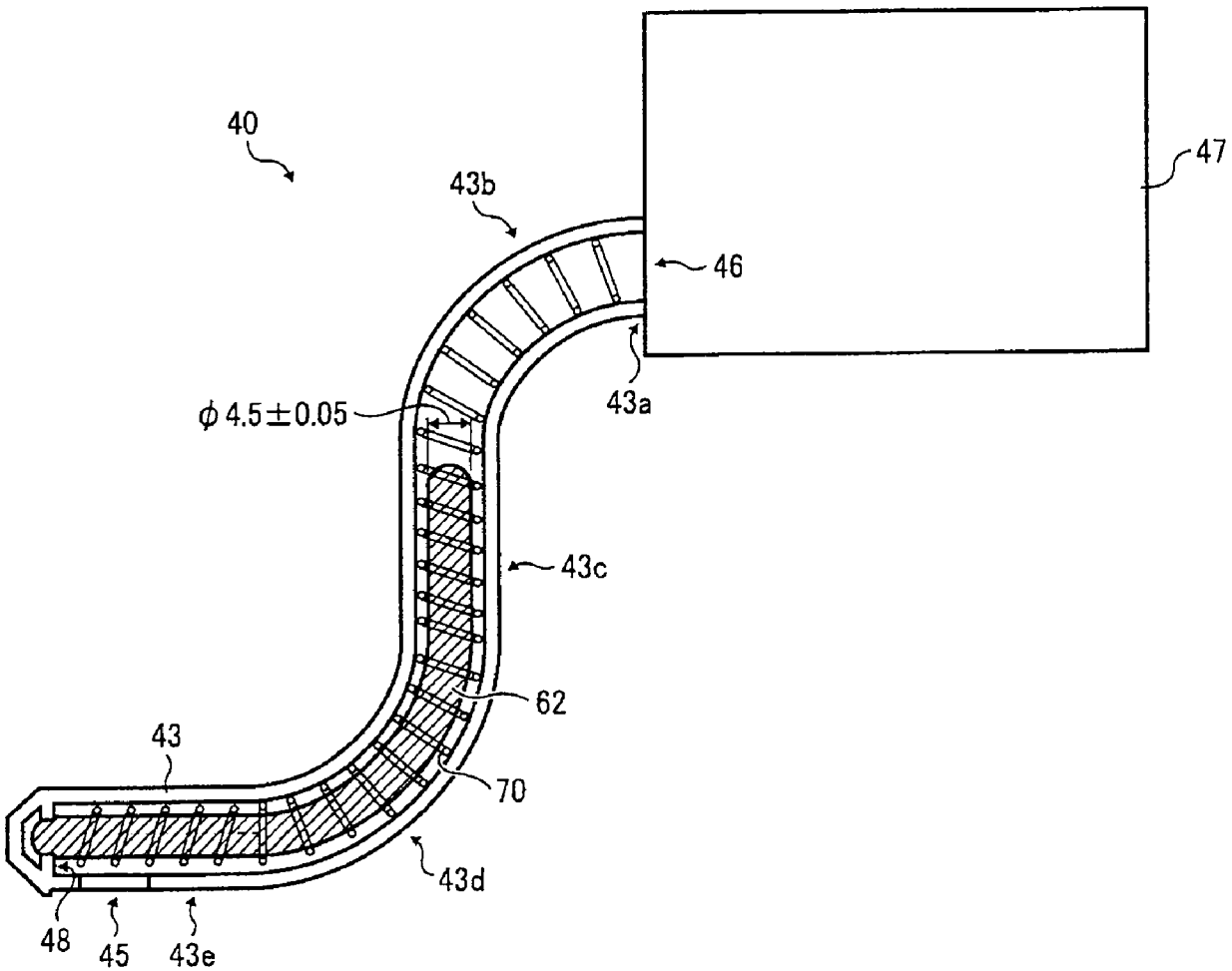
FIG. 14 illustrates an exemplary toner-conveying device including a space restriction member having the same diameter in its axial direction.

When a shaft diameter of the space restriction member 62 is equal in its axial direction as shown in FIG. 14, a path in the toner conveyance pipe 43 at a space restriction member 62 for conveying toner route is narrowed, whereby the toner is hardly conveyed over a section of the toner conveyance pipe 43 occupied by the space restriction member 62. Thus, since an amount of toner decreases in the vicinity of a replenishment inlet 45 or a sliding contact load of the conveyance coil 70 increases, a replenishment amount of the toner to the developing device 5 per second possibly significantly decreases.

In contrast, the outer diameter of the space restriction member 62 located in the toner conveyance pipe 43 is made smaller at the downstream side horizontal 43*e* than that at the slant section 43*c* in this embodiment, whereby a space is kept in the vicinity of a replenishment inlet 45 so that the toner accumulates there. As a result, significant decrease of the amount of toner replenished to the developing device 5 through the replenishment inlet 45 can be suppressed.

Further, a size of a sectional shape of the space restriction member 62 becomes smaller step by step at the slant section 43*c*, the downstream side curvature section 43*d*, and the downstream side horizontal section 43*e*, in this order. In other words, the sectional shape is changed to become smaller from the bending start section 43*s* to the bending end section 43f in the downstream side curvature section 43*d*. Thus, the outer diameter is not significantly changed between the slant section 43*c* and the downstream side curvature section 43*d* connecting the downstream side horizontal section 43*e*. Further, each of corners of boundaries (edges) of the space restriction member 62 is cut away. Further, a size of the cross sectional shape of the space restriction member 62 can gradually decrease from the slant section 43*c* to the downstream side of the horizontal 43*e*.

As a result, catching of the conveyance coil 70 on the space restriction member 62 can be prevented at the downstream side curvature section 43*d* where the downstream side horizontal section 43*e* is connected to the slant section 43*c*. Since concentration of stress onto a section where the outer diameter of the space restriction member 62 significantly decreases can be prevented, the intensity of the space restriction member 62 can be maintained.

Now, a fifth exemplary configuration is described with reference to FIG. 15. As shown, a space restriction member 62 is arranged from a downstream horizontal section 43*e* to a slant section 43*c* in the toner conveyance pipe 43. Further, a cross section of the space restriction member 62 becomes smaller step by step at the slant section 43*c*, the downstream side curvature section 43*d*, and the downstream side horizontal section 43*e* in this order. Beside, as shown in FIG. 15, a passage restriction section 106 having high toner passage restriction ability is arranged at the upstream side horizontal section 43*a*.

Toner replenishment from the toner bottle 32 is executed to a toner conveyance device 40 from a toner ejection outlet (not shown) per rotation of the toner bottle 32. Since toner replenishment is executed per rotation, an amount of toner replenished at once exceeds that conveyed by the conveyance coil 70. The excessive toner then flows through the center space of the conveyance coil 70 and reaches the developing device 5 regardless of rotation of the conveyance coil 70. Thus, a lot of toner is supplied to the developing device 5 per rotation of the toner bottle 32, and density of toner in the developing device 5 sharply increases and possibly causes a problem, such as background stein, etc.

Figure 15:
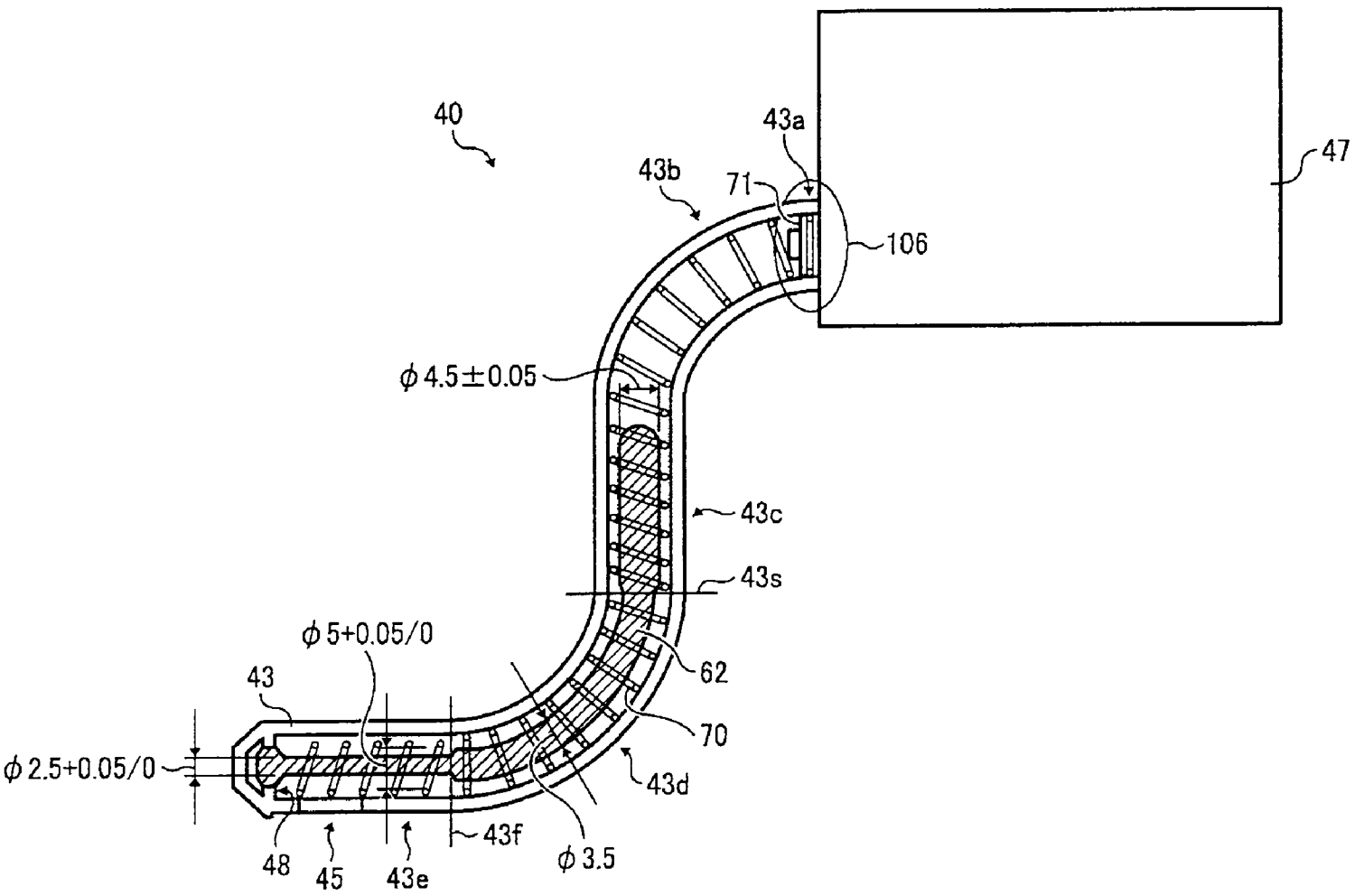
FIG. 15 schematically illustrates a fifth exemplary configuration of a toner conveyance device of the present invention.
Figure 16:
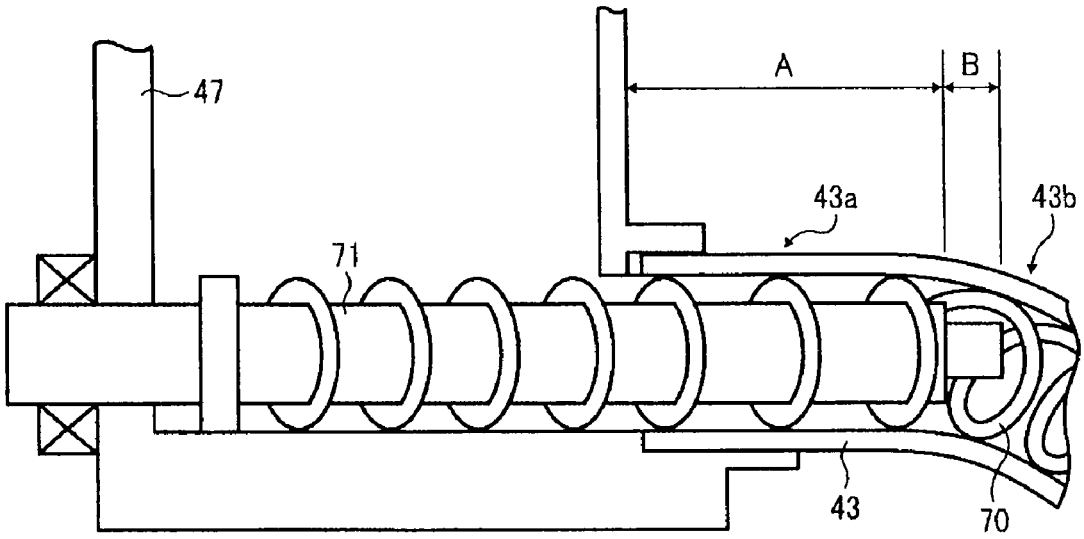
FIG. 16 illustrates exemplary surroundings of a passage restriction section arranged in the toner conveyance device of the fifth exemplary configuration.

Thus, as shown in FIG. 15, a passage restriction section 106 having a high restricting performance of restricting an amount of toner passing through the toner conveyance pipe 43 is arranged at the upstream side horizontal section 43*a* thereof. In the passage restriction section 106, a rotational shaft 71 is adhered to the inside of the conveyance coil 70. Further, more than one winding of the conveyance coil 70 is provided in the region A as shown in FIG. 16. In the region A, since the conveyance coil 70 contacts the inside of the toner conveyance pipe 43Y, and the rotational shaft 71 contacts the inside of the conveyance coil 70, and further, more than one winding of the conveyance coil 70Y is provided, almost no gap exists for the toner to pass through the region A by own weight. Thus, regardless of a time of ejection of the toner from the toner container 47, flow of the toner is stopped in the region A, and is allowed to pass only when the conveyance coil 70 rotates.

Further, as shown in FIG. 16, a diameter of the rotation shaft 71 is made smaller in the region B than that in the region A. The leading end of the rotational shaft 71 extends from the upstream side horizontal section 43*a* to almost an inlet where the upstream side curvature section 43*b* starts bending. By forming the passage restriction section 106 formed by the rotational shaft 71 and the conveyance coil 70 as wide as possible, a performance of restricting passage of toner can be increased. Thus, when the leading end of the rotational shaft 71 of the downstream side of a toner conveyance direction extends almost up to the inlet where the upstream side curvature section 43*b* starts bending, the passage restriction section 106 can widely be formed and a performance of restricting passage of toner can be improved. However, when the diameter of the rotational shaft 71 is the same over the entire region A, the leading end of the downstream side of the rotational shaft 71 of the toner conveyance direction interferes with the inner wall of the toner conveyance pipe 43 in the vicinity of the inlet where the upstream side curvature section 43*b* starts bending, the rotational shaft 71 and the toner conveyance pipe 43 or the like can be damaged.

Thus, by making the diameter of the rotational shaft 71 smaller in the region B than in the region A as shown in FIG. 16, the leading end of the downstream side of the rotational shaft 71 in the toner conveyance direction does not interfere with the inner wall of the toner conveyance pipe 43 in the vicinity of the inlet, and the rotational shaft 71 and the toner conveyance pipe 43 or the like are not damaged. The toner passage restriction performance exerted by the rotational shaft 71 and the conveyance coil 70 somewhat decreases in the region B. However, since the leading end of the rotational shaft 71 extends up to the region B, the toner conveyance path is narrowed in the region B, toner passage is restricted in proportion to an amount of narrowing.

Further, since the space restriction member 62 is arranged from the downstream side horizontal section 43*e* to the slant section 43*c* in this exemplary configuration as in the fourth exemplary configuration, an amount of air in a pipe of the toner conveyance pipe 43 is decreased by the space restriction member 62. Thus, excessive blending of the toner with the air, and accordingly, excessive increase of fluidity of the toner can be suppressed.

Thus, even though the fluidity of the toner excessively increases on the upstream side horizontal section 43*a* of the toner conveyance pipe 43 owing to the above-mentioned reason, the toner is hardly flown in to the slant section 43*c* of the toner conveyance pipe 43. Further, even though the toner is flown into the slant section 43*c*, since the toner conveyance pipe 43 includes a small amount of air in the pipe from the slant section 43*c* to the downstream side horizontal section 43*e*, the toner is not excessively blended with the air, and accordingly, toner fluidity does not excessively increase, thereby the toner is not flown into the developing device 5Y. Accordingly, a prescribed amount of the toner is more steadily replenished to the developing device 5Y.

Further as mentioned in the first embodiment, in the conventional toner conveying device of the Japanese Patent Application Laid Open No. 2005-24665 which attempts preventing the above-mentioned toner flowing into a developing device 5, since the inside of the toner conveyance pipe 43 is almost occupied by the air when excellent fluidity toner having acceleration coagulation degree of not more than 40% is used, the toner is excessively blended with the air, and the fluidity of the toner excessively increases and the toner is excessively conveyed to the downstream of the toner conveyance pipe 43 per second. As a result, a lot of toner flows into the developing device needlessly. In contrast, as mentioned above, since the space restriction member 62 is arranged in the toner conveyance pipe 43 and an amount of the air decreases in the toner conveyance pipe 43, excessive blending of the toner with the air is suppressed. As a result, even though the toner of excellent fluidity having the acceleration coagulation degree of not more than 40% is used, excessive increase of the toner fluidity in the toner conveyance pipe 43, and accordingly undesirable flowing of the toner can be suppressed.

Further, according to the toner conveying device 40 of this embodiment, by suppressing excessive increase of the toner fluidity in the toner conveyance pipe 43, the above-mentioned flowing of toner can be suppressed, even when the toner includes one of an average circular shape degree of not less than 0.90 (0.90 to 1.00), a small diameter, such as a weight average particle diameter of from 3 to 8 micrometer, a ratio (D4/D1) of from 1.00 to 1.10 between a weight average particle diameter (D4) and an item number average particle diameter (D1), etc., and polymerization toner, which conventionally caused the toner flowing into the developing device as discussed in the Japanese Patent Application Laid Open No. 2005-24665.

Thus, a high quality image can be formed using the printer 100 even employing these toner.

Now, a third embodiment of an exemplary printer 100 employing an electrophotographic system is described. The fundamental configuration and toner used in the printer 100 in this embodiment are the same as that 100 of the first embodiment. Thus, their descriptions are omitted.

A sixth exemplary configuration is initially described with reference to FIG. 17. As shown, a space restriction member 63 is arranged from a downstream horizontal section 43*e* to a slant section 43*c* in the toner conveyance pipe 43. The downstream side end of the space restriction member 63 in the toner conveyance direction is either adhered and secured or loosely supported with a clearance by a support section 48 arranged in the toner conveyance pipe 43. A conveyance coil 70 is arranged between the internal wall of the toner conveyance pipe 43 and the space restriction member 63. The outer diameter of the space restriction member 62 is set slightly smaller than the internal diameter of the conveyance coil 70, whereby a toner passage restriction performance is highly exerted. For example, the internal diameter of the conveyance coil 70 is about 5 mm with tolerance of from 0 to +0.05. The diameter of the space restriction member 63 located at a portion of the slant section 43*c* and the downstream side curvature section 43*d* of the toner conveyance pipe 43 is about 3.8 mm with tolerance of from 0 to −0.2.

As shown in FIG. 19, in a conveyance toner-conveying device, a space at the slant section of the toner conveyance pipe is almost occupied by air when ordinarily used. Thus, the air is excessively blended with the toner and increases fluidity of the toner when toner largely spending images are successively printed. However, as in this exemplary configuration, by arranging the space restriction member 63 from the downstream side horizontal section 43*e* to the slant section 43*c*, an amount of the air decreases in the ranged from the downstream side horizontal section 43*e* to the slant section 43*c*, whereby the air is prevented from being excessively blended with the toner.

Thus, by arranging the space restriction member 63 from the downstream side horizontal section 43*e* to the slant section 43*c* of the toner conveyance pipe 43, excessive flowing of the toner to the developing device 5 can be suppressed. Further, it is recognized through inventor's investigation that when a difference between the diameter of the space restriction member 63 and the internal diameter of the conveyance coil 70 is not more than 1.0 mm, the excessive flowing of the toner into the developing device 5 can largely be suppressed.

Further, as the range, in which the difference between the diameter of the space restriction member 63 and the internal diameter of the conveyance coil 70 is not more than 1.0 mm, extends longer in the space restriction member axis direction, brushing (load) of the conveyance coil 70 and the space restriction member 63 against the toner, and compression of the toner repeatedly occurs between the conveyance coil 70 and the space restriction member 63 due to an operation of the conveyance coil 70. Thus, coagulation of the toner is caused. As a result, the toner coagulates and is crushed on a printing surface, so that a spot error appears on an image. Then, by minimizing the range, in which the difference between the diameter of the space restriction member 63 and the internal diameter of the conveyance coil 70 is not more than 1.0 mm, in the space restriction member axis direction as smaller as possible, the brushing against the toner and the compression of the toner only momentary occur, so that toner coagulation hardly occurs. In view of this, as shown in FIG. 18, the difference between the diameter of the space restriction member 63 and the internal diameter of the conveyance coil 70 is not more than 1.0 mm in a region from the leading end of the space restriction member 63 at the slant section 43*c* to the downstream side of the toner conveyance direction by 10 mm in the space restriction member axis direction.

When the gap between the space restriction member 63 and the conveyance coil 70 is too narrow, the space restriction member 63 and the conveyance coil 70 brush against each other and generate brushing lord due to the operation of the conveyance coil 70. As a result, the conveyance coil 70 can be deformed or damaged, while the toner conveyed by the conveyance coil 70 receives load and coagulates. Thus, in this exemplary configuration, the difference between the diameter of the space restriction member 63 and the internal diameter of the conveyance coil 70 is not less than 0.3 mm. Thus, the brushing load caused by brushing of the space restriction member 63 and the conveyance coil 70 can be suppressed, and the deformation and damage on the conveyance coil 70 as well as the toner coagulation can be suppressed.

In view of this, by setting the difference between the diameter of the space restriction member 63 and the internal diameter of the conveyance coil 70 from not to be less than 0.3 mm to not more than 1.0 mm, the deformation and damage on the conveyance coil 70 as well as the toner coagulation and the excessive flowing of the toner to the developing device 5.

Figure 18:
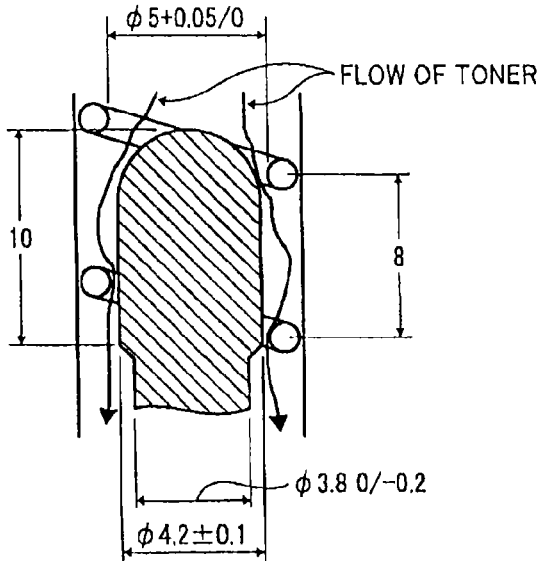
FIG. 18 illustrates an exemplary space restriction member and a conveyance coil arranged on the slant section of the toner conveyance pipe.

Further, as shown in FIG. 18, a winding interval of the conveyance coil 70 is 8 mm. When the range, in which the difference between the diameter of the space restriction member 63 and the internal diameter of the conveyance coil 70 is not more than 1.0 mm, is shorter than the winding interval of the conveyance coil 70, the conveyance coil 70 is hooked by a step formed at a section where the diameter of the space restriction member 63 largely changes, and strange sound can occur or the conveyance coil 70 can possibly be deformed and/or damaged.

Thus, the length of the above-mentioned range is from equal to twice of the winding interval of the conveyance coil 70, so that the conveyance coil 70 is not hooked by the step of space restriction member 63, while preventing the generation of the strange sound and the deformation and/or damage on the conveyance coil 70. In view of this, the length of the above-mentioned range is 10 mm to be included in the equal and twice of the winding interval of the conveyance coil 70.

Further, the above-mentioned range is preferably located at the upstream side of the space restriction member 63 in the space restriction member axis direction as upstream as possible. That is, since the range is located at the upstream side of the space restriction member 63, dropping force of the toner can be suppressed before a dropping speed of the toner dropped from the toner container section 47 onto the toner conveyance pipe 43 reaches at the highest, and suppression of the toner flowing into the developing device 5 can be achieved.

Figure 17:
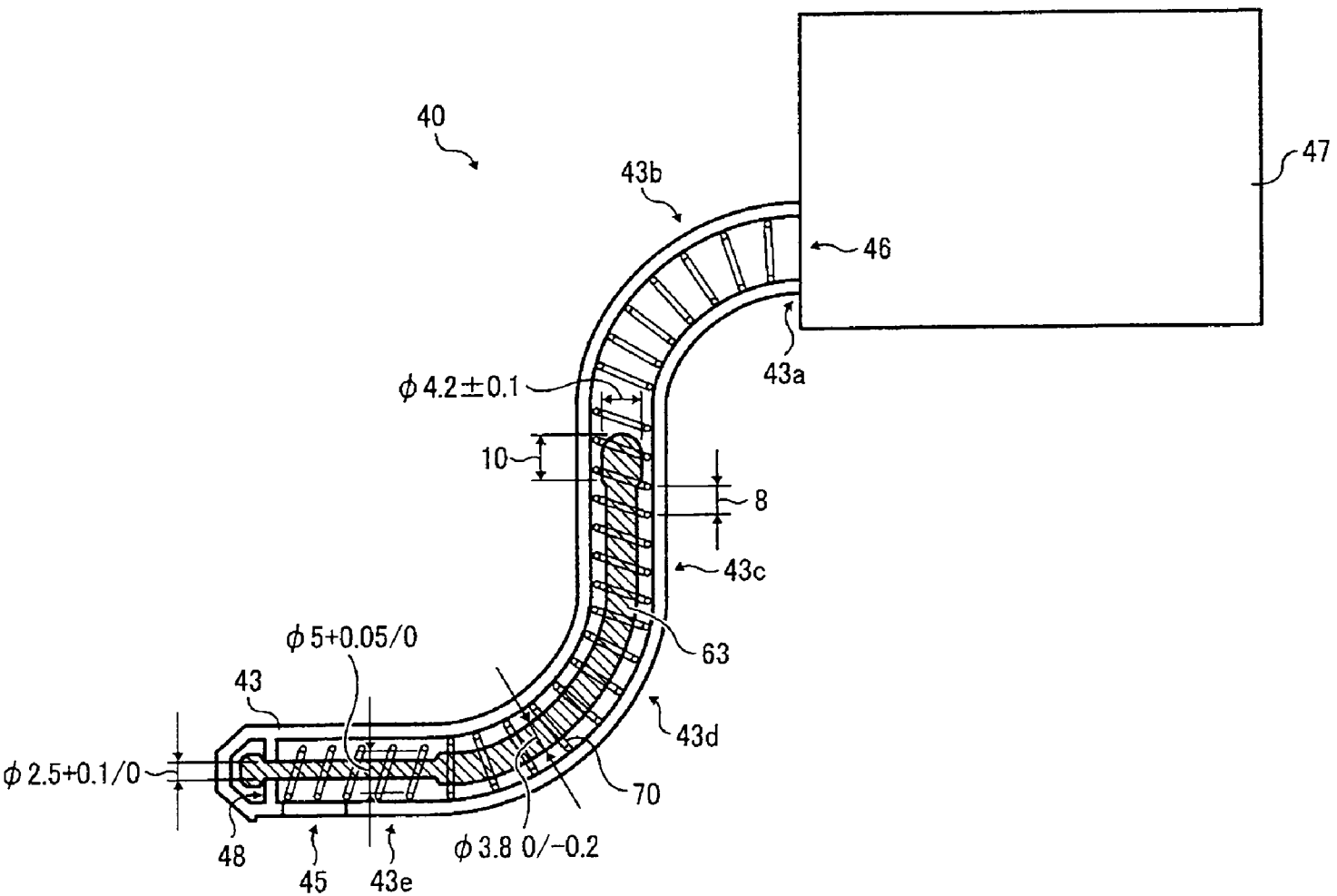
FIG. 17 schematically illustrates a sixth exemplary configuration of the toner replenishment device of the present invention.

Further, as shown in FIG. 17, to provide a space for accumulating toner in the vicinity of the replenishment inlet of the downstream side horizontal section 43*e* of the toner conveyance pipe 43, the diameter of the space restriction member 63 at the downstream side horizontal section 43*e* is smaller than that 63 at the slant section 43*c*. In this configuration, the diameter of the space restriction member 63 at the downstream side horizontal section 43*e* is 2.5 mm with tolerance of from zero to +0.1.

When the shaft diameter of the space restriction member 63 is equal in the space restriction member axis direction, a path for conveying the toner within the toner conveyance pipe 43 becomes narrower. As a result, the toner is hardly conveyed over the entire region of the toner conveyance pipe 43 having the space restriction member 63. Thus, since the amount of toner sometimes decreases in the vicinity of the replenishment inlet 45 or brushing load against the conveyance coil 70 sometimes increases, a replenishment amount of toner replenished per second to the developing device 5 possibly significantly decreases.

Then, by decreasing the diameter of the space restriction member 63 at the downstream side horizontal section 43*e* to be less than that at the slant section 43*c*, and thereby providing the space for accumulating the toner in the vicinity of the replenishment inlet 45 and accumulating the toner there, significant decrease of the toner replenished to the developing device 5 through the replenishment inlet 45 can be suppressed.

Further, a toner coagulation degree is experimented and evaluated as described below using the toner replenishment device of the sixth exemplary configuration while changing a difference between the diameter of the space restriction member 63 and the internal diameter of the conveyance coil 70 within a range not more than 1.0 mm. As preparatory for the experiment, the toner bottle and the conveyance coil 70 are repeatedly turned on and off simultaneously for 0.3 sec using the DC motor and toner is then replenished to the toner container section 47 and the slant section 43*c*. That is, when the toner is put into a vacant toner container section 47 or such a slant section 43 of the toner conveyance pipe 43, the toner tends to flow into the downstream side horizontal section 43*e* at once thereby being easily excessively ejected from the replenishment inlet 45. Thus, not to cause such toner flow in the above-mentioned manner, the drive turning on time is decreased and drive turning off time is increased so that the toner is slowly replenished to the toner container section 47 or the slant section 43.

After the experiment preparatory, the range, in which the difference between the diameter of the space restriction member 63 and the internal diameter of the conveyance coil 70 is not more than 1.0 mm, is changed to encompass the entire space restriction member 63 located at the slant section 43*c* in the axis direction, and the conveyance coil 70 is consecutively operated by the DC motor to turn on for 0.8 second and turn off for 0.4 second at 510 rpm, and conveys the toner supplied from the toner container section 47 to the toner conveyance pipe 43. Then, the range is changed to extend by 20 mm, 16 mm, and 10 mm from the leading end of the space restriction member 63 located at the slant section 43*c* in the axis direction, and the conveyance coil 70 is consecutively operated by the DC motor to turn on for 0.8 sec and turn off for 0.4 sec at 510 rpm, and conveys the toner supplied from the toner container section 47 to the toner conveyance pipe 43 in each of cases. Then, about 20 g of the toner thus conveyed by the conveyance coil 70 and ejected from the replenishment inlet 45 is picked up and is then subjected to sieve having the mesh of 106 micrometer. Then, in accordance with the size and the quantity of toner coagulation member formed by coagulation of the toner after the sieve, a coagulation degree of the toner is ranked. For example, the rank five is best, and as the rank descends, the toner coagulation degree increases as shown in the table 1 of FIG. 20 as a result of the experiment. As understood from the table, by decreasing the above-mentioned range, the toner coagulation can be suppressed.

As mentioned in the first embodiment, when the toner of fine fluidity having an accelerated coagulation degree of not more than 40% is used in the conventional toner conveying device as in the Japanese Patent Application Laid Open No. 2005-24665, since the toner conveyance pipe 43Y is almost occupied by air, the toner is excessively blended with the air, and accordingly, the fluidity of the toner excessively increases, so that the toner is excessively conveyed downstream of the toner conveyance pipe 43 per second. As a result, a lot of developer flows into the developing device side needlessly.

In contrast, according to this exemplary configuration of the toner-conveying device 40, the space restriction member 62 is arranged in the toner conveyance pipe 43 and an amount of the air decreases in the toner conveyance pipe 43, whereby excessive blending of the toner with the air is suppressed. Thus, even though the toner having the accelerated coagulation degree of not more than 40% is used, excessive increase of fluidity and flowing of the toner into the developing device is suppressed.

Further, according to the toner conveying device 40 of this embodiment, by suppressing excessive increase of the toner fluidity in the toner conveyance pipe 43, the above-mentioned undesirable flowing of the toner can be suppressed, even when the toner includes one of an average circular shape degree of not less than 0.90 (0.90 to 1.00), a small diameter, such as a weight average particle diameter of from 3 to 8 micrometer, a ratio (D4/D1) of from 1.00 to 1.10 between a weight average particle diameter (D4) and an item number average particle diameter (D1), etc., and polymerization toner, which conventionally caused the toner to flow into the developing device from the toner conveying device even if the toner flowing suppression system is employed as discussed in the Japanese Patent Application Laid Open No. 2005-24665.

Accordingly, by using this toner in the printer 100 of this embodiment, a high quality image can be obtained.

ADVANTAGE

According to the present invention, excessive increase of fluidity of powder can be suppressed, and flowing of the powder at once from the powder conveyance pipe to the conveyance destination can be suppressed.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A powder conveyance device, comprising:

a powder container section configured to contain powder;

a powder conveyance pipe configured to guide downstream the powder mixed with air from the powder container section; and a powder conveyance member configuration to convey the powder installed in the powder conveyance pipe toward a conveyance destination;

said powder conveyance pipe including:

a first conveyance section having a supply inlet and communicating with the powder container section, said first conveyance section being configured to receive the powder from the powder container through the supply inlet;

a second conveyance section communicating downstream with the first conveyance section via a first bending section, said second conveyance section downwardly extending to the conveyance destination being inclined from a horizontal at a larger angle than the first conveyance section;

a third conveyance section communicating downstream with the second conveyance section via a second bending section, said third conveyance section extending toward the conveyance destination being inclined from the horizontal at a smaller angle than the second conveyance section, said third conveyance section having a replenishment outlet for replenishing the powder from the powder conveyance pipe to the powder conveyance destination; and a space restriction member at least arranged in the second conveyance section and configured to partially close an inner space of the second conveyance section, wherein said space restriction member is arranged from the second conveyance section to the third conveyance section via the second bending section.

2. The powder conveyance device as claimed in claim 1, further comprising a powder passage restriction section arranged in the first conveyance section and configured to restrict passage of the powder.

3. The powder conveyance device as claimed in claim 1, wherein:

said space restriction member is arranged from the second conveyance section to the third conveyance section via the second bending section, and a gap between the space restriction member and an inner wall of the third conveyance section is larger than that between the space restriction member and an inner wall of the second conveyance section.

4. The powder conveyance device as claimed in claim 1, wherein:

the powder conveyance member includes a coil member, the space restriction member is installed in a hollow section of the coil member, and the space restriction member is a cylindrical shape, and wherein a difference between the diameter of a part of the space restriction member in the second conveyance section and that of an internal diameter of the powder conveyance member is not more than 1.0 mm.

5. A powder conveyance device, comprising:

a powder container section configured to contain powder;

a powder conveyance pipe configured to guide downstream the powder mixed with air from the powder container section; and a powder conveyance member configuration to convey the powder installed in the powder conveyance pipe toward a conveyance destination;

said powder conveyance pipe including:

a first conveyance section having a supply inlet and communicating with the powder container section, said first conveyance section being configured to receive the powder from the powder container through the supply inlet;

a second conveyance section communicating downstream with the first conveyance section via a first bending section, said second conveyance section downwardly extending to the conveyance destination being inclined from a horizontal at a larger angle than the first conveyance section;

a third conveyance section communicating downstream with the second conveyance section via a second bending section, said third conveyance section extending toward the conveyance destination being inclined from the horizontal at a smaller angle than the second conveyance section, said third conveyance section having a replenishment outlet for replenishing the powder from the powder conveyance pipe to the powder conveyance destination; and a space restriction member at least arranged in the second conveyance section and configured to partially close an inner space of the second conveyance section, wherein said space restriction member is arranged from the second conveyance section to the third conveyance section via the second bending section, and wherein a gap between the space restriction member and an inner wall of the third conveyance section is larger than that between the space restriction member and an inner wall of the second conveyance section.

6. The powder conveyance device as claimed in claim 5, wherein said gap between the space restriction member and the inner wall of the third conveyance section is not less than 1.0 mm.

7. The powder conveyance device as claimed in claim 5, wherein a cross section of said space restriction member gradually decreases from the second conveyance section to the third conveyance section.

8. The powder conveyance device as claimed in claim 5, wherein a cross section of said space restriction member gradually decreases in the second conveyance section, the second bending section, and the third conveyance section in this order.

9. The powder conveyance device as claimed in claim 5, wherein a powder passage restriction section is provided in the first conveyance section.

10. The powder conveyance device as claimed in claim 5, further comprising a powder passage restriction section arranged in the first conveyance section and configured to restrict passage of the powder.

11. The powder conveyance device as claimed in claim 5, wherein:

said space restriction member is arranged from the second conveyance section to the third conveyance section via the second bending section.

12. The powder conveyance device as claimed in claim 5, wherein:

the powder conveyance member includes a coil member, the space restriction member is installed in a hollow section of the coil member, and the space restriction member is a cylindrical shape, and wherein a difference between the diameter of a part of the space restriction member in the second conveyance section and that of an internal diameter of the powder conveyance member is not more than 1.0 mm.

13. A powder conveyance device comprising:

a powder container section configured to contain powder;

a powder conveyance pipe configured to guide downstream the powder mixed with air from the powder container section; and a powder conveyance member configuration to convey the powder installed in the powder conveyance pipe toward a conveyance destination;

said powder conveyance pipe including:

a first conveyance section having a supply inlet and communicating with the powder container section, said first conveyance section being configured to receive the powder from the powder container through the supply inlet;

a second conveyance section communicating downstream with the first conveyance section via a first bending section, said second conveyance section downwardly extending to the conveyance destination being inclined from a horizontal at a larger angle than the first conveyance section;

a third conveyance section communicating downstream with the second conveyance section via a second bending section, said third conveyance section extending toward the conveyance destination being inclined from the horizontal at a smaller angle than the second conveyance section, said third conveyance section having a replenishment outlet for replenishing the powder from the powder conveyance pipe to the powder conveyance destination; and a space restriction member at least arranged in the second conveyance section and configured to partially close an inner space of the second conveyance section, wherein the powder conveyance member includes a coil member, wherein the space restriction member is installed in a hollow section of the coil member, and wherein the space restriction member is a cylindrical shape, and wherein a difference between the diameter of a part of the space restriction member in the second conveyance section and that of an internal diameter of the powder conveyance member is not more than 1.0 mm.

14. The powder conveyance device as claimed in claim 13, wherein the space restriction member is longer than a winding interval of the coil and shorter than twice the same.

15. The powder conveyance device as claimed in claim 13, wherein a difference between the diameter of the space restriction member and that of the internal diameter of the powder conveyance member is not less then 0.3 mm.

16. The powder conveyance device as claimed in claim 13, further comprising a powder passage restriction section arranged in the first conveyance section and configured to restrict passage of the powder.

17. The powder conveyance device as claimed in claim 13, wherein:

wherein said space restriction member is arranged from the second conveyance section to the third conveyance section via the second bending section.

18. The powder conveyance device as claimed in claim 13, wherein:

said space restriction member is arranged from the second conveyance section to the third conveyance section via the second bending section, and a gap between the space restriction member and an inner wall of the third conveyance section is larger than that between the space restriction member and an inner wall of the second conveyance section.

* * * * *